US006392516B1

(12) United States Patent
Ward et al.

(10) Patent No.: US 6,392,516 B1
(45) Date of Patent: May 21, 2002

(54) LATCHING SOLENOID WITH IMPROVED PULL FORCE

(75) Inventors: James R. Ward, Milwaukee; Derek A. Dahlgren, Wauwatosa; Thomas J. Stobbs, deceased, late of Brookfield, all of WI (US), by Diana Stobbs, legal representative

(73) Assignee: TLX Technologies, Waukesha, WI (US)

( * ) Notice: Subject to any disclaimer, the term of this patent is extended or adjusted under 35 U.S.C. 154(b) by 0 days.

(21) Appl. No.: 09/721,030

(22) Filed: Nov. 22, 2000

Related U.S. Application Data

(63) Continuation-in-part of application No. 09/444,625, filed on Nov. 22, 1999, and a continuation-in-part of application No. 09/205,290, filed on Dec. 4, 1998, now Pat. No. 6,198,369.

(51) Int. Cl.[7] ..... H01F 3/00

(52) U.S. Cl. ..... 335/255; 335/220; 335/278

(58) Field of Search ..... 335/220–229, 335/253, 255, 278–284; 351/127.01, 129.06, 129.15–129.22; 336/198, 206, 225

(56) References Cited

U.S. PATENT DOCUMENTS

| | | | | |
|---|---|---|---|---|
| 2,352,119 A | | 6/1944 | Putt | |
| 3,805,204 A | * | 4/1974 | Peterson | 335/255 |
| 4,049,232 A | | 9/1977 | Byers, Jr. | |
| 4,071,042 A | | 1/1978 | Lombard et al. | |
| 4,302,743 A | | 11/1981 | Araki | |
| 4,403,765 A | | 9/1983 | Fisher | |
| 4,686,501 A | | 8/1987 | Palmier | |
| 4,796,661 A | | 1/1989 | Hishinuma et al. | |
| 4,845,392 A | | 7/1989 | Mumbower | |
| 4,863,142 A | | 9/1989 | Hendrixon et al. | |
| 4,883,091 A | | 11/1989 | Weiler et al. | |
| 4,971,114 A | | 11/1990 | Ichihashi et al. | |
| 4,989,829 A | | 2/1991 | Bickel | |
| 5,000,420 A | | 3/1991 | Hendrixon et al. | |
| 5,000,421 A | | 3/1991 | Hendrixon et al. | |
| 5,051,631 A | | 9/1991 | Anderson | |
| 5,059,813 A | | 10/1991 | Shiroyama | |
| 5,065,979 A | | 11/1991 | Detweiler et al. | |
| 5,067,687 A | | 11/1991 | Patel et al. | |
| 5,069,420 A | | 12/1991 | Stobbs et al. | |
| 5,075,584 A | | 12/1991 | Hendrixon et al. | |
| 5,096,025 A | | 3/1992 | Herberg | |
| 5,137,125 A | | 8/1992 | Troltsch et al. | |
| 5,178,359 A | | 1/1993 | Stobbs et al. | |
| 5,238,018 A | | 8/1993 | Hashida | |
| 5,299,600 A | | 4/1994 | Aronovich | |
| 5,309,944 A | | 5/1994 | Chikamatsu et al. | |

(List continued on next page.)

FOREIGN PATENT DOCUMENTS

| | | |
|---|---|---|
| EP | 1059647 | 8/2000 |
| FR | 2319184 | 5/1975 |

*Primary Examiner*—Lincoln Donovan
(74) *Attorney, Agent, or Firm*—Reinhart Boerner Van Deuren, s.c.

(57) ABSTRACT

A latching solenoid includes a pole member, an armature movable relative to the pole member, a solenoid coil assembly for positioning the armature relative to the pole member, and a magnetic flux shunt structure. The shunt structure bridges the air gap between the pole face and the armature face, providing a low reluctance magnetic flux path between the pole member and the armature to increase the attractive force between the armature and the pole member. The shunt structure can be a saturation tip formed integrally with the armature or a separate flux shunt member configured as a ring which is fixed to the armature. The armature can be maintained latched by the effects of residual magnetism or by a permanent magnet.

13 Claims, 15 Drawing Sheets

U.S. PATENT DOCUMENTS 5,328,147 A 7/1994 Stobbs
5,330,153 A 7/1994 Reiter
5,340,032 A 8/1994 Stegmaier et al.
5,377,720 A 1/1995 Stobbs et al.
5,503,184 A 4/1996 Reinartz et al.
5,518,219 A 5/1996 Wenzel et al.
5,538,026 A * 7/1996 Kazi ..... 251/129.08
5,547,165 A 8/1996 Brehm et al.
5,577,534 A 11/1996 Ward
5,632,467 A * 5/1997 Just et al. ..... 251/129.21
5,655,633 A 8/1997 Nakadate et al.
5,732,888 A 3/1998 Maier et al.
5,915,665 A * 6/1999 Paese et al. ..... 251/45
6,198,369 B1 3/2001 Ward et al.

* cited by examiner

LATCHING SOLENOID WITH IMPROVED PULL FORCE

CROSS REFERENCE TO RELATED APPLICATIONS

This application is a continuation-in-part of application Ser. No. 09/444,625, which was filed on Nov. 22, 1999, and application Ser. No. 09/205,290, which was filed on Dec. 4, 1998, now U.S. Pat. No. 6,198,369.

BACKGROUND OF THE INVENTION

Field of the Invention

The present invention relates generally to solenoids, and more particularly, to latching solenoids which include a magnetic flux shunt member for providing a low reluctance magnetic flux path between an armature and a pole member, for example, of the solenoid as the armature is driven toward a latching position.

Electromagnetic actuators include a solenoid coil for moving an armature relative to a pole member or an end wall of a case of the actuator, for example, in carrying out a control function. When the armature is to be driven toward the pole member, initially, a large air gap will exist between opposing faces of the armature and the pole member. The air gap provides a high reluctance path for magnetic flux produced by the solenoid coil for driving the armature toward the pole member. The high reluctance results in a reduced magnetic force, particularly at the full stroke position for the armature. Consequently, a relatively large attractive force must be produced to move the armature toward the pole member. In known actuators, producing a greater force generally requires increasing the size of the solenoid coil, and resulting in a larger size for the solenoid package.

Both the response time of the actuator and the turn-on threshold are a function of the amount of attractive force produced by the device. The amount of force which can be generated by electromagnetic actuators is related to the relative sizes of the magnetic pole and the armature, the number of turns of solenoid coil and the current that is applied to the solenoid coil. The solenoid coil size generally determines the dimensions of the device because the solenoid coil is wound on the magnetic pole. Thus, methods of maximizing the attractive force generated by such devices are usually directed to optimizing the magnetic circuit of the device.

The operating efficiencies of actuators can be increased to some extent by improving the magnetic flux coupling between the magnetic pole piece and the armature. Arrangements for improving such magnetic flux coupling in proportional actuators are disclosed in copending U.S. patent application Ser. No. 09/205,920 of James R. Ward and Derek Dahlgren, which was filed on Dec. 4, 1998, and which is assigned to the assignee of the present application. This application, Ser. No. 09/205,920, is incorporated herein by reference. The application discloses a proportional actuator which includes a saturation tip formed on the movable armature of the actuator for directing magnetic flux through a pole piece to the armature. The saturation tip bridges the air gap that exists between the opposing surfaces of the armature and the pole piece when the armature is spaced apart from the pole piece. The actuator includes a step-wound coil which provides a region of increased diameter for accommodating the saturation tip, allowing the working diameters of the armature and the pole piece to be increased for a given size actuator, with a corresponding increase in the attractive force produced by the magnetic circuit of the device actuator.

Maximizing attractive force is an important factor in latching solenoids. Most known latching solenoids use flat face technology to maximize the attractive force. Another technique for improving magnetic flux coupling, and thus attractive force, between a magnetic pole piece and armature of a latching solenoid is to provide a conical shape for the armature to concentrate the flux and thereby increase the attractive force. However, the use of a conical shape results in a smaller area for latching in latching solenoids. Thus, it would be desirable to minimize the effect of the air gap for magnetic flux to cross as the armature is being driven to the latched position.

SUMMARY OF THE INVENTION

The disadvantages and limitations of the background art discussed above are overcome by the present invention. With this invention, there is provided a latching solenoid including a magnetic pole member having a pole end portion and an armature supported for movement relative to the magnetic pole member between first and second positions. The armature has an armature end portion which is located adjacent to the pole end portion. The armature end portion is spaced apart from the pole end portion when the armature is in the first position. One of the end portions defines a saturation tip which projects from the one end portion. The saturation tip is configured and arranged to overlap at least a portion of the other one of the end portions when the armature is moved away from the first position. The latching solenoid further includes a bias structure producing a bias force for moving the armature to the first position, and a coil assembly including a step-wound coil for moving the armature relative to the magnetic pole piece against the force of the bias structure from the first position to the second position, the armature being maintained in the second position by the effects of a magnetic force.

In one embodiment, the magnetic force for maintaining the armature in the second position is produced by the effects of residual magnetism. In another embodiment, the magnetic force for maintaining the armature in the second position is produced by a permanent magnet.

Further in accordance with the invention, there is provided a latching solenoid including a pole member of a magnetic material including a pole face, and an armature of a magnetic material, including an armature end portion having an armature face opposing the pole face. The armature is supported for movement relative to the pole face between first and second positions. The armature face is spaced apart from the pole face, defining an air gap between the armature face and the pole face, when the armature is in the first position. The latching solenoid further includes a coil assembly for producing magnetic flux along a magnetic flux path for moving the armature from the first position to the second position. The armature is maintained in the second position by the effects of a magnetic force. A magnetic flux shunt structure of a magnetically permeable material is carried by the armature, located adjacent to the pole face. The magnetic flux shunt structure is configured and arranged to shunt at least a portion of the air gap between the armature face and the pole face when the armature is in the first position to provide a low reluctance magnetic flux path between the pole member and the armature.

In one embodiment, the magnetic flux shunt structure comprises a saturation tip which is formed integrally with the armature. In accordance with another embodiment, the magnetic flux shunt structure comprises a magnetic shunt member which is fixed to the armature. The magnetic shunt member can be of a material that is different from the material of the armature.

The separate shunt member allows the flatness of the pole member to be easily maintained to facilitate the obtaining optimum latching forces. In addition, the separate shunt member allows the pole member and/or the armature to be made of a material that is different from the material of the shunt member. For example, in one preferred embodiment, the shunt member is of a soft material which provides for improved pull-in force from the unengaged to the engaged position. The armature and the pole member can be of high carbon content material which provides for improved residual latching forces in the engaged position.

The magnetic flux shunt structure results in greater magnetic attractive force at relatively long strokes and tends to equalize the attractive force over the length of the stroke. Accordingly, for a given size package, a larger magnetic force is obtained for the solenoid including a magnetic flux shunt structure as compared to that produced for a comparably sized solenoid without the magnetic flux shunt structure. Alternatively, a comparable force can be provided using a lower level of current for energizing the solenoid winding, allowing the use a smaller package, as compared with a comparably sized solenoid that does not include a magnetic flux shunt structure. Moreover, because a larger force is provided, the solenoid can use a stiffer bias spring, if desired.

Another advantage provided by the magnetic flux shunt structure of the present invention is that the coextensive surface areas of the pole face and of the armature face can be maximized as compared to a comparably sized solenoid that does not include a magnetic flux shunt structure.

Yet another advantage provided by the magnetic flux shunt structure is minimization of the air gap for magnetic flux to cross as the armature is being driven from the disengaged position to the engaged position.

In preferred embodiments, the solenoid is a latching solenoid, the latching mechanism being either residual magnetism or a permanent magnet in the magnetic flux path of the solenoid.

Other advantages and features of the invention, together with the organization and the manner of operation thereof, will become apparent from the following detailed description when taken in conjunction with the accompanying drawings, wherein like elements have like numerals throughout the drawings.

DESCRIPTION OF THE DRAWINGS

These and other advantages of the present invention are best understood with reference to the drawings, in which.

DETAILED DESCRIPTION OF THE PREFERRED EMBODIMENTS

Figure 1:
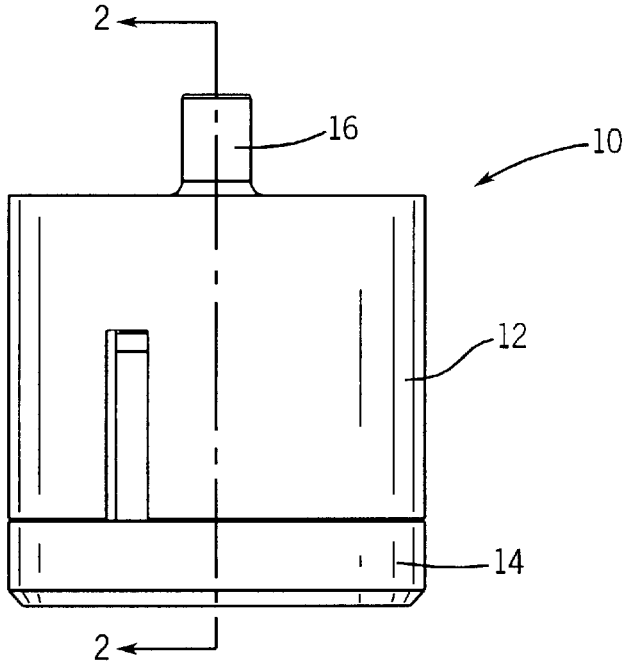
FIG. 1 is an elevation view of a latching solenoid including a magnetic flux shunt structure in accordance with the present invention.
Figure 2:
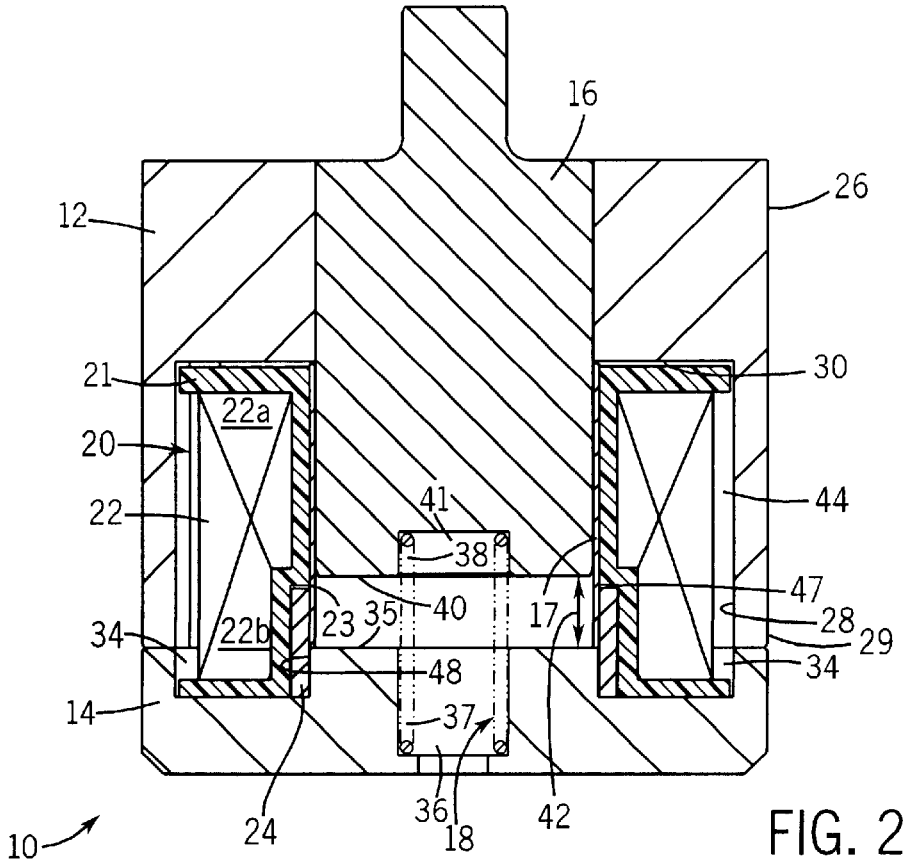
FIG. 2 is a vertical section view taken along the line 2—2 of FIG. 1.
Figure 3:
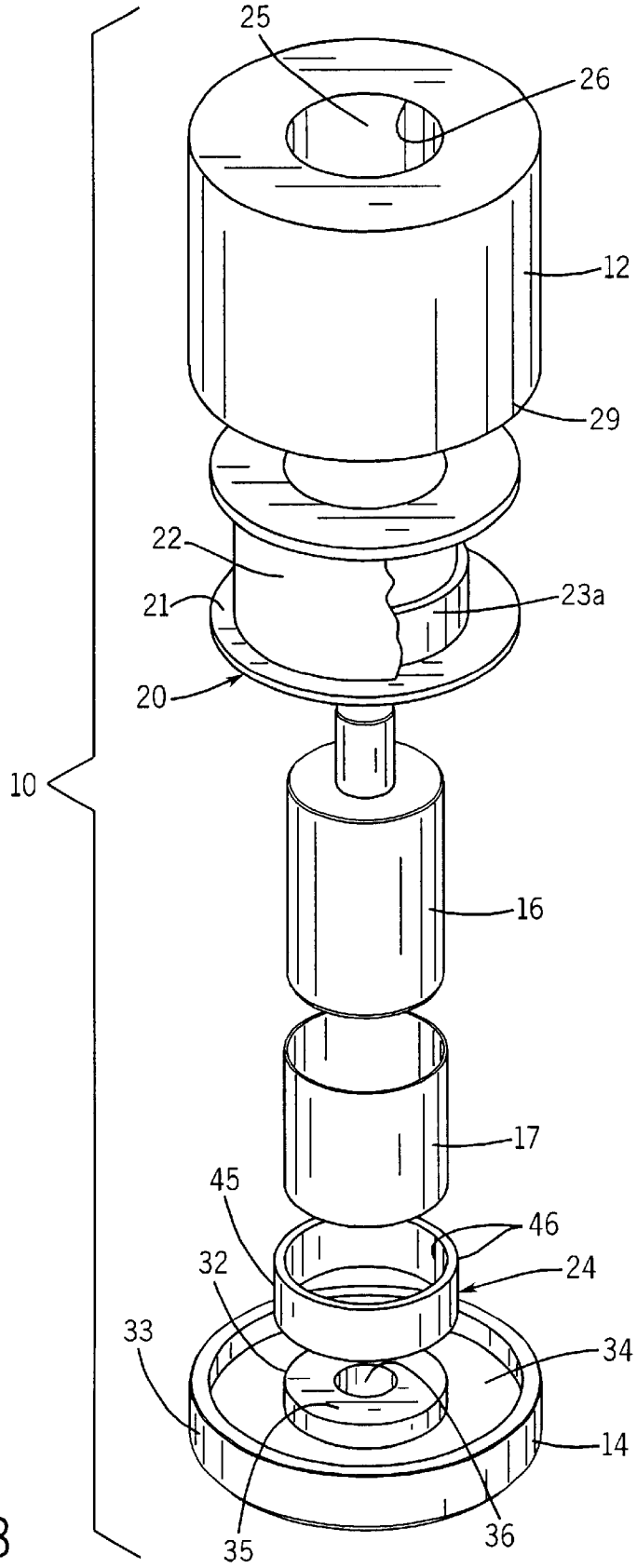
FIG. 3, is an exploded isometric view of the latching solenoid of FIG. 1, with the bias member not being shown.

Referring to FIGS. 1–3 of the drawings, there is shown a latching solenoid 10 in accordance with one embodiment of the invention. The latching solenoid 10 includes a case or body 12, a magnetic pole member 14, an armature 16, a guide member 17, a bias structure 18 (FIG. 2) and a coil assembly 20. In one embodiment, the bias structure 18 is a spring member, such as a coil spring. The bias structure 18 is interposed between the armature 16 and the pole member 14 for biasing the armature to an unengaged position, as shown in FIG. 2. The coil assembly 20 is adapted for driving the armature 16 from the unengaged position to a engaged position shown in FIG. 5. In accordance with the invention, the latching solenoid 10 includes a magnetic flux shunt structure 24 for providing a low reluctance magnetic flux path between the pole member and the armature as the armature is driven toward the engaged position.

Considering the latching solenoid 10 in more detail, the body 12 is generally cylindrical in shape and has a through bore 25 (FIG. 3) from one end 26 of the body to the opposite end 29 of the body. The bore 25 is countersunk at end 29, defining an interior cavity 30 for the body for locating the coil assembly 20. The body 12 can be of steel or other suitable magnetic material.

The pole member 14 is a generally flat, disc-like element which includes a center hub 32 and an annular side wall 33 spaced apart from the center hub 32, defining an annular channel 34. The center hub 32 defines a generally circular pole surface or face 35 for the pole member 14. The hub 32 includes a recess 36 for locating one end 37 of the bias structure 18, as shown in FIG. 2 for example. The magnetic pole member 14 is mounted on the body 12 at one end 29 thereof, closing the end 29 of the body 12. The magnetic pole member 14 can be made of steel or any other suitable magnetic material. The latching solenoid 10 includes a separate magnetic pole member 14. However, the pole face can be defined by a portion, such as an end wall portion, of the body 12, in the manner described herein for other embodiments of solenoids including a shunt structure. In such embodiments, the body is a generally cup-like member and in such embodiments, an end wall of the body defines a pole face and provides the function of a magnetic pole member. Thus, in this description and in the appended claims, the term pole member should be broadly construed as reading on a separate member or a portion of the case or body of the solenoid.

The armature 16 is a generally cylindrical element which can be made of steel or some other magnetic material. The armature has an armature surface or face 40 which corresponds in shape and size to pole surface 35. The armature surface 40 includes a recess 41 which receives the other end 38 of the bias structure 18. The armature 16 is mounted in the body 12 near end 26 thereof for reciprocating movement within the body 12 relative to the pole member 14 between the engaged and unengaged positions. In the engaged position shown in FIG. 5, the armature surface 40 engages the pole surface 35. In the unengaged or full stroke position shown in FIG. 2, the armature surface 40 is disposed in an opposing spaced relationship with the pole surface 35 of the magnetic pole member 14, defining a working or air gap 42.

In one embodiment, residual magnetism maintains the armature in a position to which it has been driven. However, the armature can be maintained in a position to which it has been driven by a permanent magnet located in the magnetic flux path. For applications in which residual magnetism is used to maintain the armature in a position to which it is driven, the shunt structure preferably is of a soft magnetic material, such as a soft steel, and the armature, pole member and body are of a hard high carbon content material, such as a hardened steel.

In one embodiment, the coil assembly 20 includes a step-wound solenoid winding 22. The solenoid winding 22 is wound on a bobbin 21 formed with a step or shoulder 23 at one end. The outer surface of the step is indicated by the reference numeral 23*a* in FIG. 3. In one embodiment, the bobbin 21 is made of plastic. The solenoid winding 22 includes a winding portion 22*a* and a winding portion 22*b* which has an inner diameter that is larger than the inner diameter of the winding portion 22*a*. The coil assembly 20 is mounted within the body 12 near end 29, located in a chamber 44 (FIG. 2) formed by the interior cavity 30 of the body and the channel 34 in the pole member 14.

In one embodiment, the magnetic flux shunt structure 24 is configured as a ring shaped member which preferably is a separate element from the pole member and the armature. Thus, in preferred embodiments, the magnetic flux shunt structure, hereinafter referred to as shunt ring 24, is a free floating with respect to a magnetic pole member and the armature. That is, the shunt ring 24 is not fixed or attached to the magnetic pole member or to the armature. Rather, the shunt ring is positioned in relationship with the armature by an element of a non-magnetic material which can be a bobbin of the solenoid winding or a separate element, for example.

The free floating shunt ring 24 eliminates the need for tight concentricity tolerances and the need for a bearing such as that which is required for a fixed shunt ring, such as that disclosed in U.S. patent application Ser. No. 09/205,920, referenced above. The independent shunt member allows the flatness of the pole member to be easily maintained to facilitate the obtaining of optimum latching forces. In the actuators disclosed in the above-referenced application, in which the shunt ring can be part of the pole member, for example, optimum operation relies on the flatness at the bottom of a counter bore in either the pole member or the armature, which is much more difficult to maintain than when the pole surface is formed by machining a flat surface that does not include an outwardly projecting annular portion encompassing the pole surface. In addition, the separate shunt ring 24 allows the pole member and/or the armature to be made of a material that is different from the material of the shunt ring 24. For example, in one preferred embodiment, the shunt ring 24 is of a soft material which provides for improved pull-in force from the unengaged to the engaged position. The armature and the pole member can be of hardened material which provides for improved residual latching forces in the engaged position.

In one embodiment, the shunt ring 24 has a side wall 45 with parallel side surfaces 46, as shown in FIG. 3 for example. The shunt ring 24 is mounted in a channel 47 (FIG. 2) defined by the stepped portion 23 of the bobbin 21 and the inner portion of the channel 34 of the pole member 14. A first portion of the shunt ring 24 extends above the pole surface 35 and a second portion of the shunt ring 24 extends below the pole surface 35. The guide member can extend into the channel in the pole member. This maintains the guide member 17 concentric with the pole member 14 so that the armature 16, which is guided by the guide member 17 is maintained concentric with the pole member 14. The shunt ring of the latching solenoid 10 shown in FIGS. 1–3 can have a beveled edge 27 in the manner of shunt ring 28 shown in FIG. 4. The beveled edge 27 increases flux density at the tip of the shunt ring to maximize the force level at full stroke.

The inner diameter of the shunt ring 24 is greater than the outer diameter of the armature 16, allowing the armature 16 to be moved substantially axially relative to the magnetic pole member 14, through the shunt ring 24 into engagement with the pole surface 35 of the pole member 14. This allows maximizing the working diameter of the pole face 35 and the working diameter of the armature face 40 that is coextensive with the pole face 35. Generally, the length of the stroke dictates the width of the shunt ring, i.e., the vertical height of the shunt ring as viewed in FIG. 2. That is, the width or height of the shunt ring above the pole face 35, is approximately equal to the width of the air gap 42.

When the armature 16 is being driven from the unengaged position to the engaged position, the shunt ring 24 bridges substantially the entire air gap 42 between the pole face 35 and the armature face 40. The shunt ring 24 channels the magnetic flux between the armature 16 and the pole member 14, enhancing the coupling of magnetic flux between the pole member 14 and the armature 16. This results in increased magnetic force at a given level as compared to a solenoid of comparable size without the shunt ring.

Figure 4:
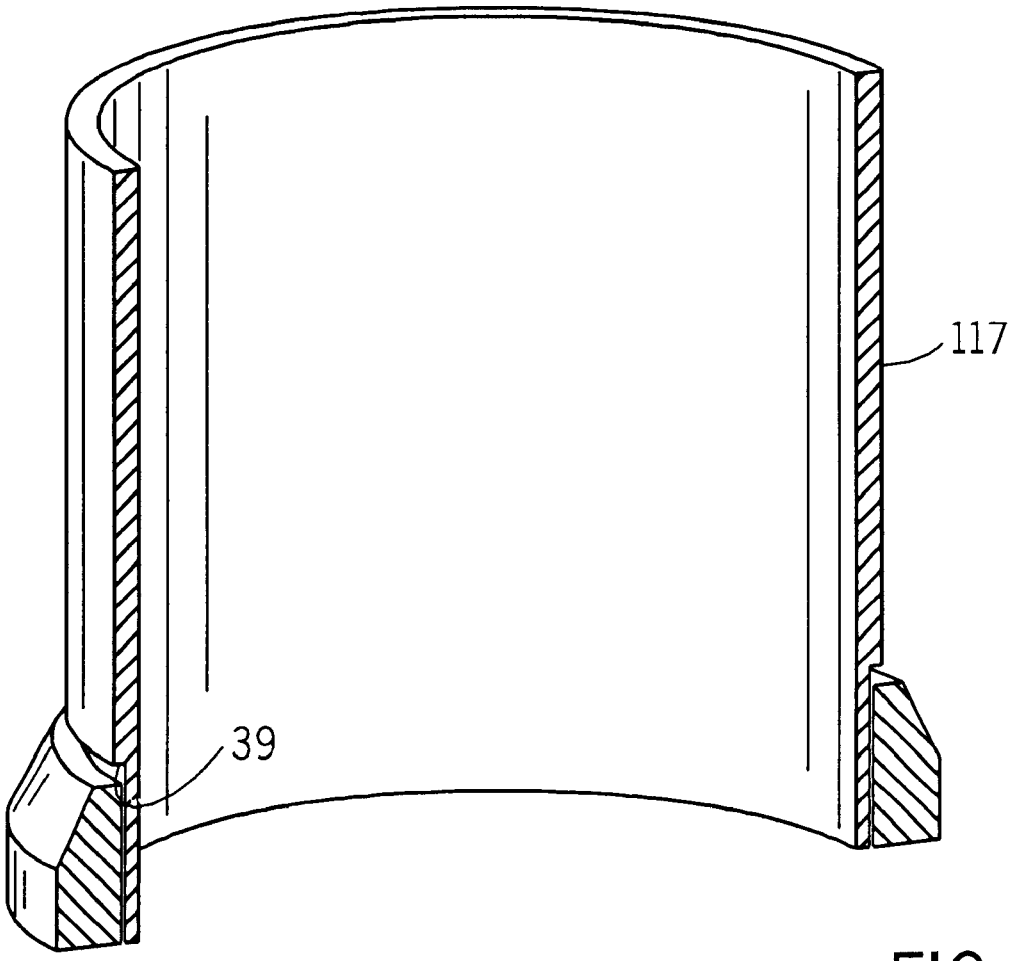
FIG. 4 is an enlarged, vertical section view of a guide member for use with the latching solenoid of FIG. 1, with a magnetic flux shunt structure in accordance with a further embodiment shown partially extending into a recess of the guide member.

The armature 16 is isolated from the shunt ring 24 by the guide member 17 which is of a non-magnetic material. In one embodiment, the guide member 17 is a sleeve-like element. In another embodiment, illustrated in FIG. 4, the guide member 19 can include a reduced outer diameter portion 39 near one end for receiving a portion of the shunt ring 24. For example, in one embodiment, the guide member 19 (or guide member 17) can be formed of a section of brass tubing having a 0.020 inch wall thickness. By way of example, the outer diameter of the guide member 19 can be reduced to about 0.008 inch to 0.009 inch, for example, to form the reduced diameter portion 39. A portion of the shunt ring 24 can extend into the reduced diameter portion 39 of the guide member 19 as shown in FIG. 4.

Referring again to FIGS. 1–3, the guide member 17 prevents the armature 16 from contacting the shunt ring 24. In addition, the guide member 17 guides the armature 16 as the armature is driven between the unengaged and the engaged positions. Thus, for example, as the armature is driven from the unengaged position to the engaged position, the guide member 17 substantially eliminates side loading. Side loading could cause the flat armature surface 40 of the armature 16 to become misaligned with the flat pole face 35 of the pole member 14, resulting in reduction of the latching force and reducing the magnetic force throughout the stroke because the armature pulls to one side under side loading conditions.

Figure 5:
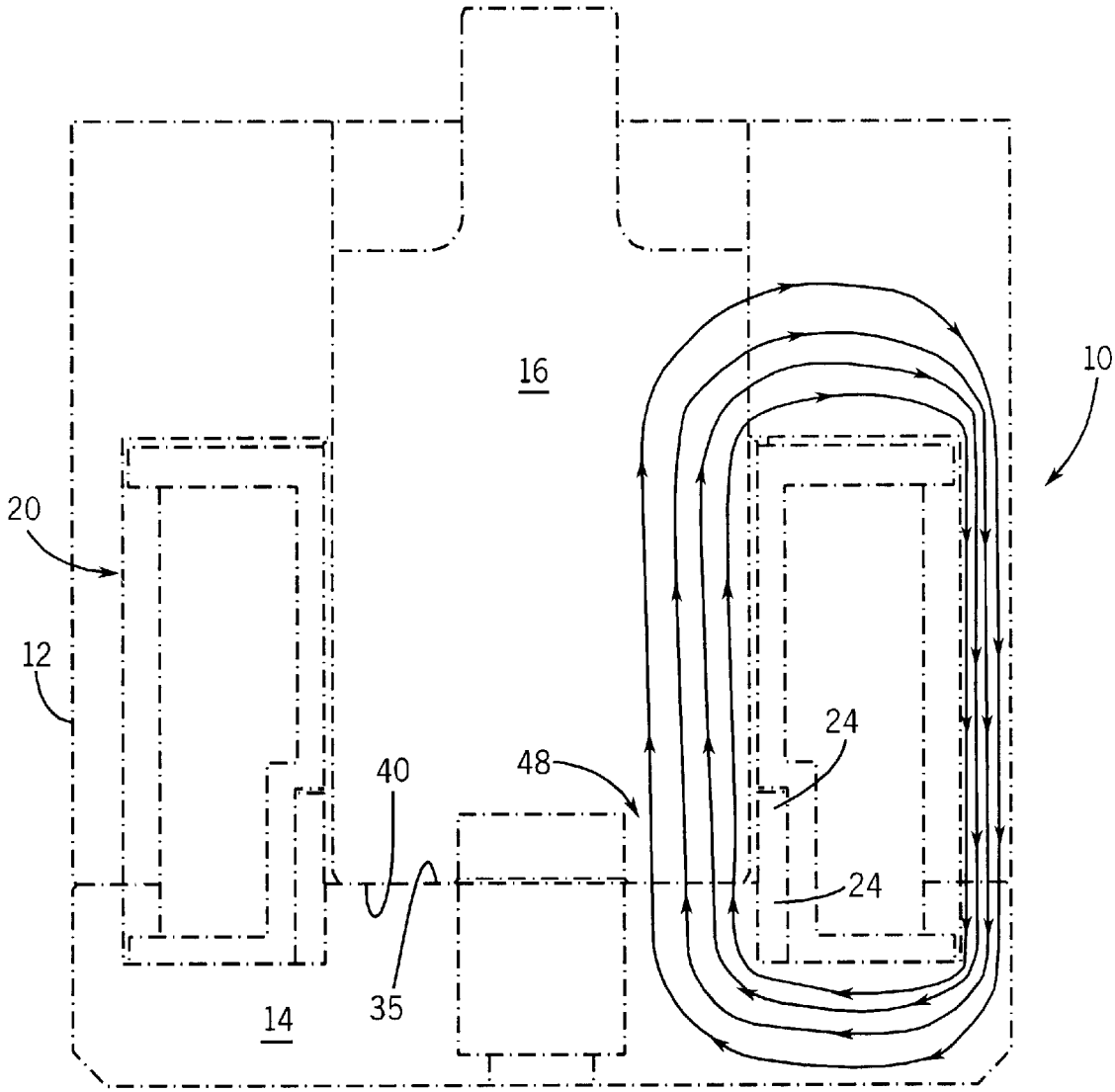
FIG. 5 is a sketch illustrating the magnetic field for the latching solenoid of FIG. 1 when the armature is in an engaged position.

FIG. 5 is a simplified representation of the magnetic flux lines or paths for magnetic flux produced by the solenoid winding 22 for the latched condition of the latching solenoid 10. FIG. 5 shows only the magnetic flux lines at one side of the solenoid, it being understood that flux lines are produced around the full extent of the solenoid winding. For this condition, the armature 16 is positioned with the armature face 40 engaging the pole face 35. Moreover, because the pole face 35 and the armature face 40 are substantially flat surfaces, there is substantially no gap between the opposing surfaces 35 and 40 of the pole member 14 and the armature 16 and the magnetic flux passes directly from the pole member 14 to the armature 14 as indicated by reference numeral 48.

Figure 6:
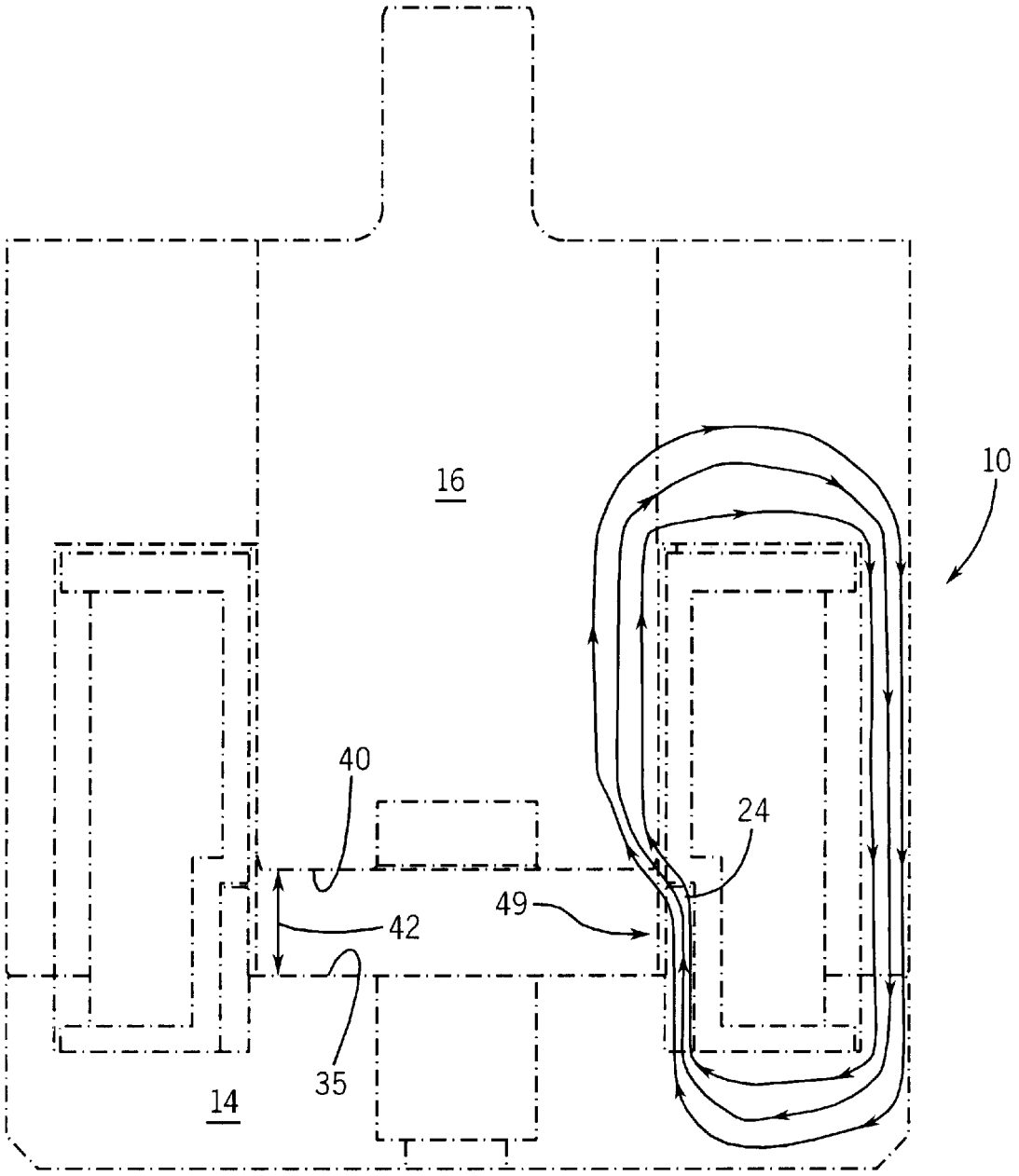
FIG. 6 is a sketch illustrating the magnetic field for the full stroke condition for the latching solenoid of FIG. 1.

In contrast, with reference to FIG. 6, there is illustrated a simplified representation of the magnetic flux lines or paths for magnetic flux produced by the solenoid winding for the full stroke condition of the latching solenoid 10. For this condition, the armature 16 is positioned spaced apart from the pole member 14 with a gap 42 between the armature face 40 and the pole face 35. The shunt ring 24 provides a shunt path around the air gap 42 for the magnetic flux with the magnetic flux passing through the shunt ring from the pole member to the armature as indicated by reference numeral 49. Because the shunt ring 24 is of a soft steel, the shunt ring will exhibit higher permeabilty than the pole member and the armature so that some of the magnetic flux will pass through the shunt ring. This results in higher magnetic attractive forces, particularly at full stroke. Without the shunt ring 24, magnetic flux would have to pass through the relatively high reluctance air gap 42 that exists between the opposing surfaces of the armature 16 and the pole member 14 when the armature is moved out of contact with the pole member.

Digressing, a further factor contributing to increased magnetic attractive force is the use of a step wound coil which allows increasing the working area of the armature 16 and the pole member 14 and the circumferential area of the shunt ring 24. The amount of attractive force which can be produced by this type of magnetic circuit is related to the coaxial diameters of the working surfaces 35 and 40 of the magnetic pole member 14 and the armature 16, the number "N" of turns of the coil assembly 20, and the current "I" applied to the solenoid winding 22. Thus, on the one hand, the configuration of the solenoid winding 22 is a factor in the higher magnetic force attraction provided between the magnetic pole member and the armature for the solenoid 10 because of the increased coaxial diameters of the armature and the pole member. Although the step-wound solenoid winding 22 results in a reduction of about 15% in coil power due to less winding space, there is an increase of about 30% in force for a winding of a given area because of the increase in the coextensive diameters of the magnetic pole member 14 and the armature 16 and the shunt ring 24.

The amount of attractive force which can be generated by this type of magnetic circuit is given by the relationship $F=kAB^2$, where A is the area of each of the coextensive portions 35 and 40 of the magnetic pole member 14 and the armature 16, B is the flux density produced by the solenoid winding 22, and k is a constant. The flux density is proportional to NI which is the product of the number of turns N of the solenoid winding 22 and the applied current I. Thus, the available force F is dependent upon the relationship between the coaxial diameters of the armature face 40 and the pole face 35.

Figure 7:
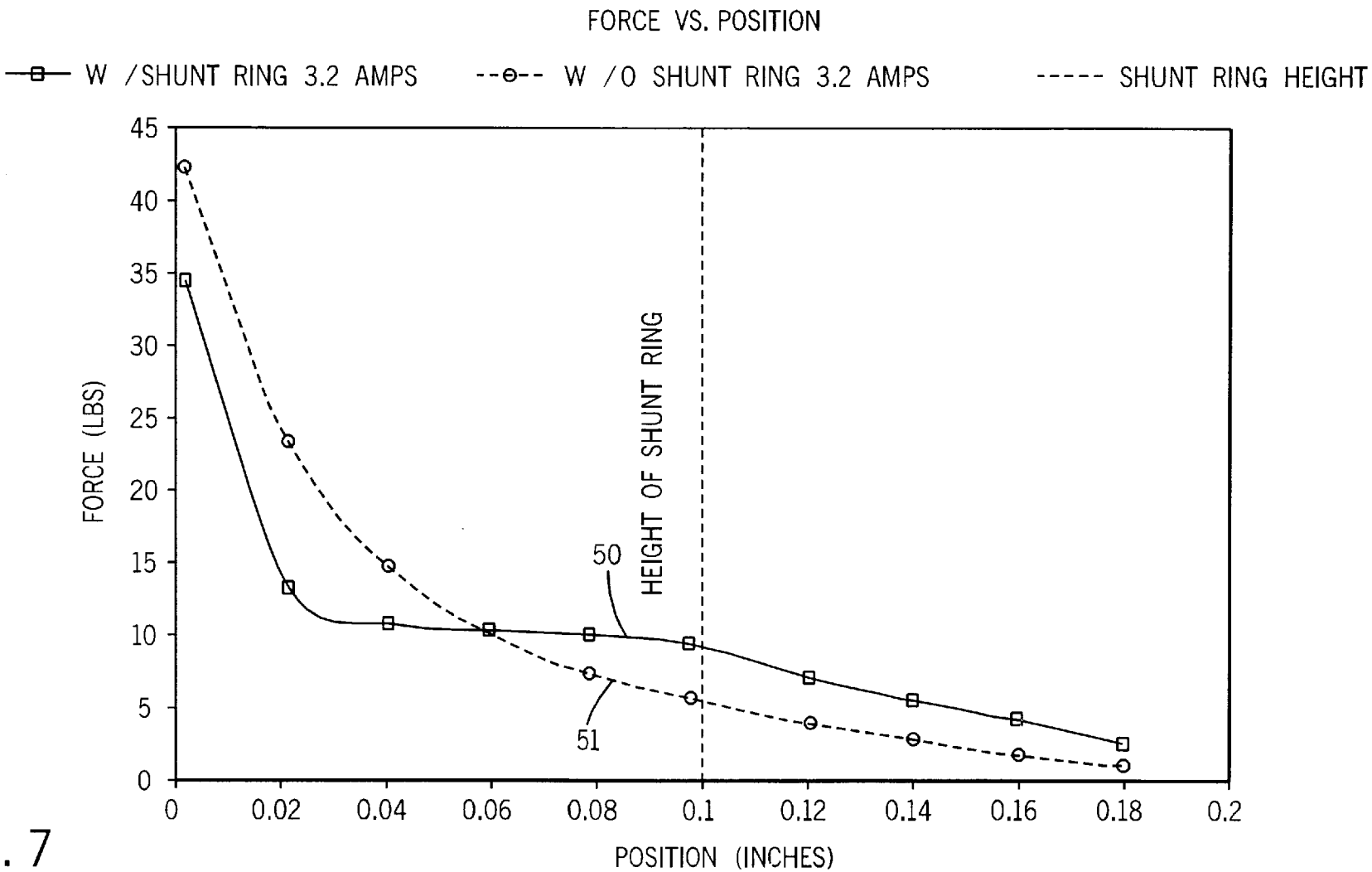
FIG. 7 shows graphs of attractive force as a function of displacement of the armature for the latching solenoid provided by the invention with the magnetic flux shunt structure and for a latching solenoid without a magnetic flux shunt structure.

Referring to the graphs of FIG. 7, the solid line curve 50 represents force, in pounds (lbs), as a function of displacement of the armature, in inches, for the latching solenoid 10 provided by the invention which includes the shunt ring 24. The dashed line curve 51 in FIG. 7 represents force as a function of displacement for a latching solenoid which is of the same construction as latching solenoid 10, but which does not include a shunt ring. The solenoid windings of both latching solenoids were energized by the same current at a level of 3.2 amperes. For latching solenoid 10, the length of portion of the shunt ring 24 extending beyond the pole surface 35 was approximately 0.100 inch. As is shown in FIG. 7, the force is substantially linear between about 0.020 inch and about 0.100 inch for the latching solenoid 10. In addition, the force for a 0.100 inch stroke provided for the latching solenoid 10 which includes the shunt ring, is approximately 10 lbs whereas the force for a 0.100 inch stroke provided for the comparable solenoid which does not include a shunt ring is less than about 7 lbs, and is approximately 65% of the force provided by latching solenoid 10. As is shown by the right hand portions of curves 50 and 51, when the stroke for both latching solenoids is increased to about 0.180 inch, the force produced decreases at the high end, but the force produced by the latching solenoid 10 is greater than the force produced by the latching solenoid that does not include a shunt ring.

As can be seen, the operating characteristic of the latching solenoid 10 provides a linear relationship between force and length of stroke from about 0.020 inch to about 0.100 inch due to the shunt ring 24. The upper limit of the linear range can be greater than or less than 0.100 inch with appropriate modifications, such as increasing or decreasing the height of the shunt ring, for example.

Figure 8:
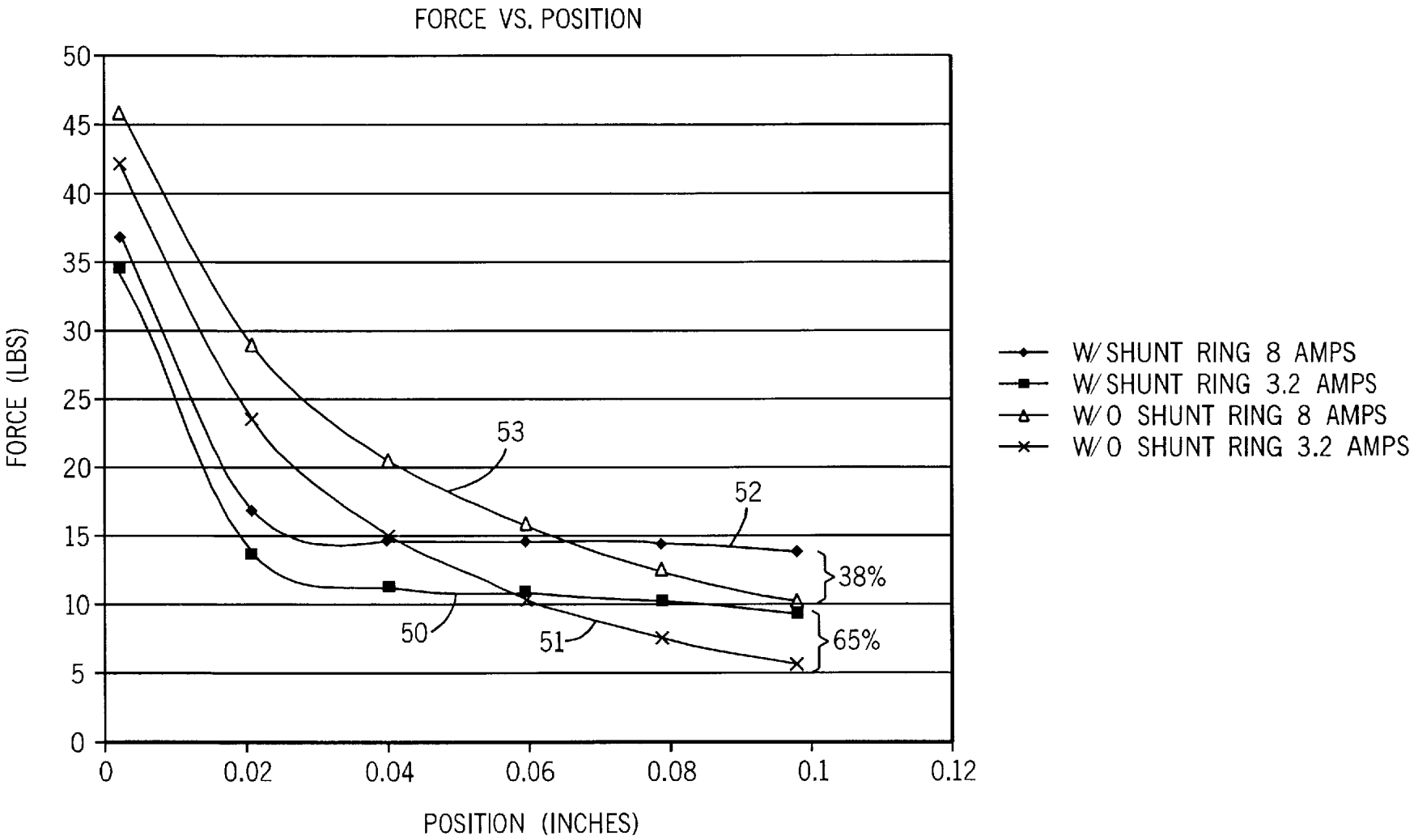
FIG. 8 shows graphs of attractive force as a function of displacement of the armature for the latching solenoid provided by the invention with the magnetic flux shunt structure and for a latching solenoid without a magnetic flux shunt structure.

Referring to FIG. 8, the same comparison between force and position for the latching solenoid 10 and a corresponding latching solenoid that does not include a shunt ring is illustrated for two different current levels. The curves 50 and 51 (FIG. 7) for a current level of 3.2 amperes are reproduced in FIG. 8 and are correspondingly numbered. In addition, FIG. 8 includes a curve 52 showing force as a function of displacement of the armature 16 for the latching solenoid 10 provided by the invention with the shunt ring for a current of 8 amperes. Curve 53 shows force as a function of displacement for the comparable latching solenoid but without a shunt ring. As can be seen, for a current level of 8 amperes, the attractive force produced by the latching solenoid 10 is 38% greater than that for the force produced by the comparable latching solenoid without a shunt ring.

Importantly, as can be seen by comparing curve 53 (for latching solenoid without a shunt ring) with curve 50 (for latching solenoid with a shunt ring), for the latching solenoid that does not include a shunt ring, a current level that is approximately 150% greater is required to produce the same attractive force that is provided by the latching solenoid 10 which includes a shunt ring in accordance with the invention.

When the solenoid coil is energized, the armature is attracted to the solenoid body 12 and is moved axially into engagement with the solenoid body. When the armature 16 has been driven into engagement with the solenoid body 12, the drive pulse is terminated and the armature is latched in engagement with the solenoid body by the effects of residual magnetism.

To release the armature 16 of the solenoid 10, a reverse polarity drive pulse is applied to the solenoid winding 22. The reverse polarity drive pulse is of sufficient amplitude to produce a magnetic force that offsets the magnetic force being produced due to the effects of residual magnetism, allowing the armature 16 to be moved out of engagement with the pole member 14 under the force of the bias structure 18.

Figure 9:
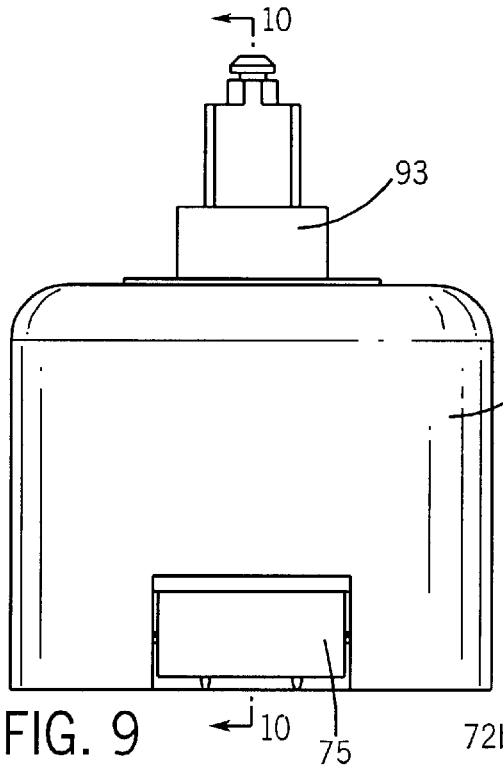
FIG. 9 is an elevation view of a latching solenoid incorporating a further embodiment of a magnetic flux shunt structure in accordance with the present invention.
Figure 10:
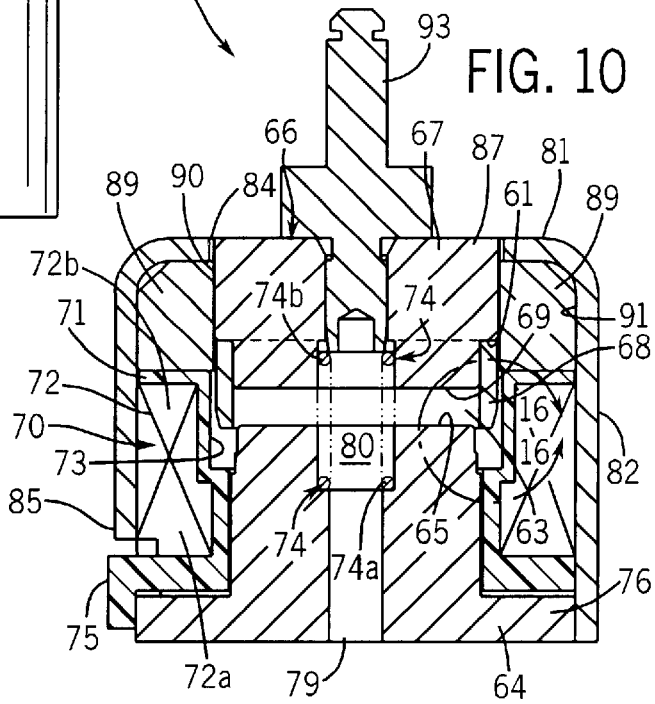
FIG. 10 is a vertical section view taken along the line 10—10 of FIG. 9.
Figure 11:
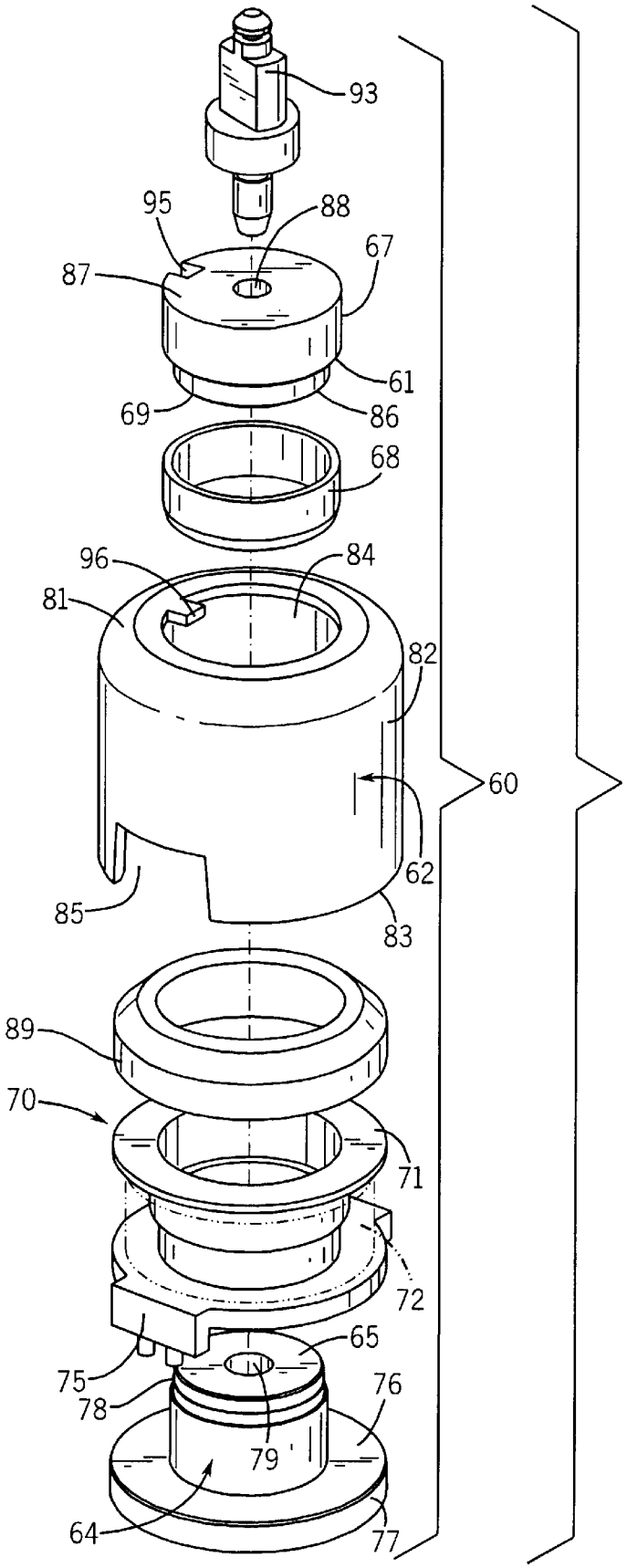
FIG. 11 is an exploded isometric view of the latching solenoid of FIG. 9.

Referring to FIGS. 9–11, there is shown a further embodiment of a latching solenoid 60 provided by the present invention. The latching solenoid 60 includes a case 62, a magnetic pole member 64, an armature assembly 66, including an armature 67 and a shunt member 68. The shunt member 68 provides a magnetic flux shunt structure for the latching solenoid 60 generally in the manner of shunt member 24 for latching solenoid 10 described above with reference to FIGS. 1–8. The latching solenoid 60 further includes a coil assembly 70 and a bias structure 74. In one embodiment, the bias structure 74 is a spring member, such as a coil spring, which is interposed between the armature and the pole member, biasing the armature out of engagement with the pole member.

Figure 16:
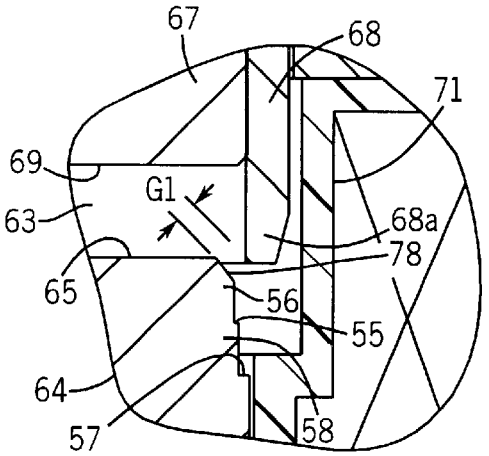
FIG. 16 is a detail view of a portion of the latching solenoid contained within the circle in FIG. 10.

The magnetic pole member 64 is a solid, generally cylindrical element having an annular flange 76 at one end 77. The pole member 64 has a generally flat pole surface 65 at the opposite end 78. Referring also to FIG. 16, in one embodiment, the diameter of the pole member 64 decreases in two steps in a direction toward end 78. The pole member 64 includes one step 55 near end 78 which defines a smaller diameter portion 56 for the pole member. The pole member 64 includes a second step 57 axially inwardly from step 55 which defines a larger diameter portion 58 for the pole member. However, the diameter of portion 58 is smaller than the diameter of the main body of the pole 64 The outer peripheral edge of the pole member at end 78 is chamfered to facilitate maintaining the flat face 65 which typically is produced by grinding the surface 65 flat in the known manner. The pole member 64 has an axial through bore 79 between the ends 77 and 78. The bore 79 is countersunk at end 78, defining an increased diameter portion 80 of the bore 79. The increased diameter portion 80 of the bore 79 locates one end 74*a* of the bias structure 74, as shown in FIG. 10, for example.

The solenoid coil assembly 70 includes a step-wound solenoid winding 72 which is wound on a bobbin 71. The bobbin 71 can be formed with a step or shoulder 73 at one end which produces a step in the solenoid winding 72 which is wound on the bobbin 71. Thus, the solenoid winding 72 includes a first winding portion 72*a* and a second winding portion 72*b* which has an inner diameter that is larger than the inner diameter of the first winding portion 72*a*. In one embodiment, the solenoid coil assembly 70 is supported on the flange 76 of the pole member 64.

The case 62 is an inverted cup-like member having a base 81, a sidewall 82 depending from the base, and an open end 83. The magnetic pole member 64 and the solenoid coil assembly 70 are received within the open end 83 of the case, and are substantially enclosed within the case 62. The case 62 has an aperture 84 through its base 81 through which extends the armature 67. The case has an opening 85 through which extends the terminals 75 for the solenoid winding 72.

The armature 67 is a generally cylindrical element having an inner end 86 and an outer end 87. The armature 67 includes a circumferential shoulder 61 (FIG. 11) near the inner end 86. The armature 67 has a flat armature surface or face 69 at its inner end 86. The outer peripheral edge of the armature 67 at the inner end 86 is chamfered to facilitate maintaining the flat face 69. The armature face 69 is disposed in opposition with the pole face 65. An annular spacer washer 89 of a magnetic material, such as steel, is interposed between the sidewall 90 of the armature 67 and the inner surface 91 of the case 62.

Figure 12:
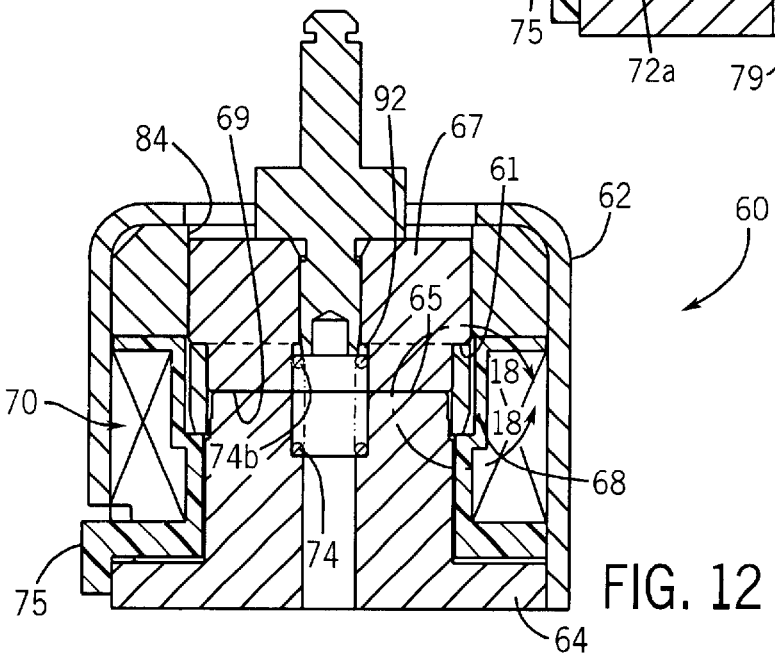
FIG. 12 is a view similar to that of FIG. 10 with the latching solenoid shown in the engaged position.

The armature assembly 66 is supported within the case 62 for axial, reciprocating movement relative to the magnetic pole member 64 between an unengaged position, shown in FIG. 10, and an engaged position, shown in FIG. 12. In the unengaged position, the armature face 69 is spaced apart from the pole face 65, providing an air gap 63 between the pole face 65 and the armature face 69. In the engaged position, the armature face 69 engages the pole face 65.

Figure 13:
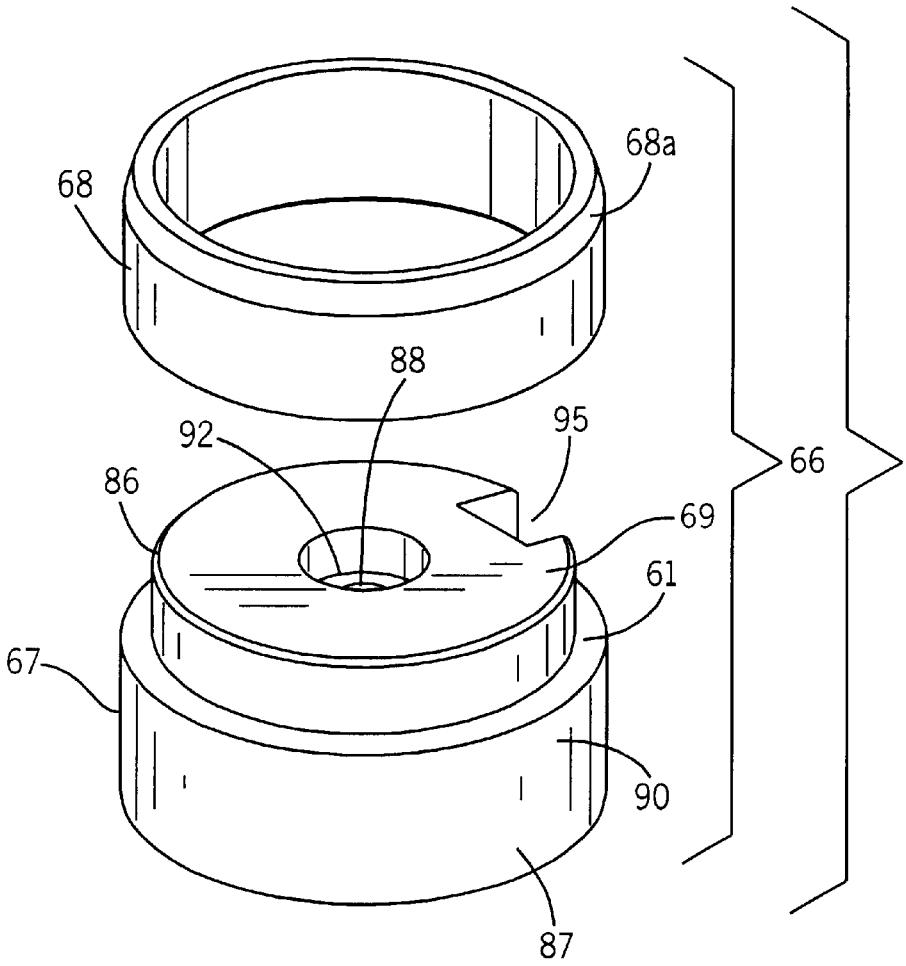
FIG. 13 is an enlarged, exploded isometric view of an armature assembly of the latching solenoid of FIG. 9, shown rotated about 180° to illustrate details of the armature.
Figure 14:
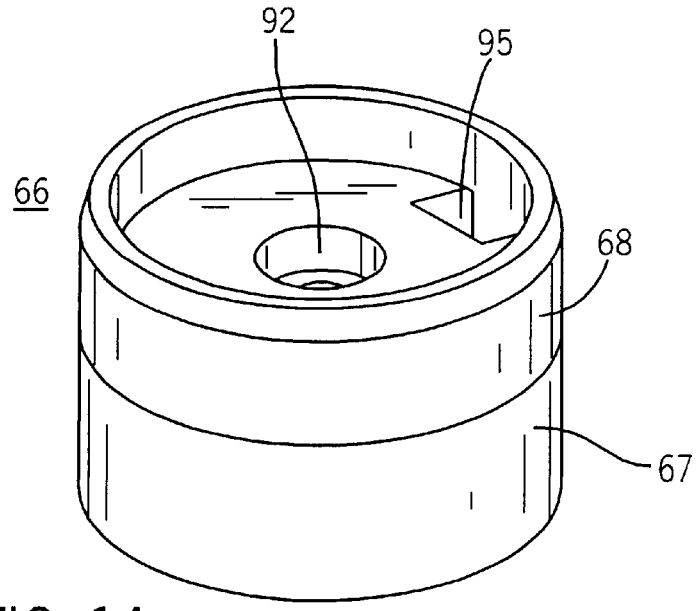
FIG. 14 is a view similar to FIG. 12 and with the armature assembly shown assembled.

Referring also to FIGS. 13 and 14, wherein the armature assembly 66 is shown rotated about 180° to illustrate details of the inner surface of the armature 67, the shunt member 68 is generally annular in shape. The inner edge 68*a* of the shunt member 68 is beveled inward radially. The inner diameter of the shunt member 68 is slightly greater than the outer diameter of the stepped portion of the armature 67, allowing the shunt member 68 to be mounted on the shoulder 61 of the armature 67 as shown in FIG. 14. In one embodiment, the radial thickness of the shunt member 68 is slightly less than the radial length of the shoulder 61 to prevent the shunt member 68 from catching on the annular spacer washer 89 as the armature is moved between engaged and disengaged positions. The shunt member 68 can be secured to the armature 67 in any suitable manner, and in one preferred embodiment, the shunt member 68 is held in place on the shoulder of the armature 67 by an interference fit.

The armature 67 has a through bore 88 which receives a pin 93 by which the latching solenoid 60 is coupled to a device being controlled by the latching solenoid 60. The pin 93 can be secured to the armature 67 in any suitable manner, such as by rolling over an edge 94 of the pin 93. The armature bore 88 is counterbored near end 86, defining an enlarged diameter portion 92 for locating the other end 74*b* of the bias member 74, as shown in FIG. 12, for example.

The armature 67 includes a notch 95 which extends axially of the armature 67 along a portion of or along the entire extent of the armature between its inner and outer ends. The notch cooperates with a projection 96 on the inner surface of the case, for preventing rotation of the armature with respect to the case.

The shunt member 68 is dimensioned to allow at least a portion of the shunt member to substantially bridge the air gap 63 between the pole face 65 of the magnetic pole member 64 and the armature face 69 of the armature 67 when the armature is in the unengaged position. That is, the width (or vertical height as viewed in FIG. 10) of the portion of the shunt member 68 that projects beyond the armature face 69 is approximately equal to the width of the air gap 63. Generally, the length of the stroke dictates the width of the shunt member, i.e., the vertical height of the shunt member as viewed in FIG. 10, for example.

In addition, the inner diameter of the shunt member 68 is slightly greater than the outer diameter of the pole member 64 allowing the armature to be moved axially relative to the pole member, and allowing the projecting portion of the shunt member 68 to overlap the end 78 of the pole member 64 when the armature 67 is moved to the engaged position.

The separate shunt member 68 makes holding concentricity of key elements easier. Moreover, the separate shunt member 68 allows the flatness of the armature 67 to be easily achieved to facilitate the obtaining optimum latching forces. In addition, the separate shunt member 68 allows the armature and/or the pole member, to be made of a material that is different from the material of the shunt member.

In one embodiment, the armature 67 is maintained in a position to which it has been driven by a magnetic force produced by the effects of residual magnetism. The attractive force produced by the residual magnetism is greater than the opposing bias forces therefore maintaining the armature 67 in position. For applications in which the effect of residual magnetism is used to maintain the armature 67 in a position to which it is driven, the shunt member 68 preferably is of a permeable magnetic material, such as a soft steel, and the armature 67, the magnetic pole member 64 and the case 62 can be of another material chosen for its optimum residual properties. The shunt member 68 being of a more permeable material provides for improved pull-in force from the unengaged to the engaged position. This is caused by the ability of the shunt member 68 to reach a higher flux density. Flux density is directly related to magnetic attractive forces. The armature 67 and the pole member 64 being of a hardened material provides for improved residual latching forces in the engaged position.

Referring to FIGS. 10 and 12, to drive the armature 67 from the disengaged position to the engaged position, a drive pulse of a first polarity is applied to solenoid winding 72. The drive pulse is of sufficient magnitude to produce attractive forces great enough to overcome the bias force produced by the bias member 74. The armature 67 is maintained in the engaged position by the magnetic field produced by the effects of residual magnetism which is greater than the bias force produced by the bias member 74.

To release the armature 67 from the engaged position, a release pulse is applied to the solenoid winding 72 for producing a magnetic field in the direction opposite to that produced by the effects of residual magnetism. Consequently, the net magnetic attractive force is reduced to an amount less than the force produced by the bias member 74, allowing the armature 67 to be returned to the disengaged position by force of the bias member 74.

The shunt member 68 functions generally in the manner of shunt ring 24 (FIG. 1) to provide a low reluctance magnetic flux path between the pole member 64 and the armature 67 as the armature 67 is being driven toward the engaged position. However, shunt member 68 is carried by the armature 67, rather than being located adjacent to the pole member in the manner of shunt ring 24. As described above with reference to FIGS. 5 and 6, for the condition in which the armature 67 is positioned spaced apart from the pole member 64, such that an air gap 63 is provided between the armature face 69 and the pole face 65, the shunt member 68 provides a shunt path around the air gap 63 for the magnetic flux, with the magnetic flux passing through the shunt member 68 from the pole member 64 to the armature 67. When the armature 67 is in the unengaged position, the air gap is smaller between the shunt member 68 and the pole member 64 so that the majority of the magnetic flux passes through the shunt member. This results in higher magnetic attractive forces, particularly at full stroke. Without the shunt member, magnetic flux would have to pass through the relatively high reluctance air gap 63 that exists between the opposing surfaces of the armature 67 and the pole member 64 when the armature is moved toward the pole member 64.

Figure 15:
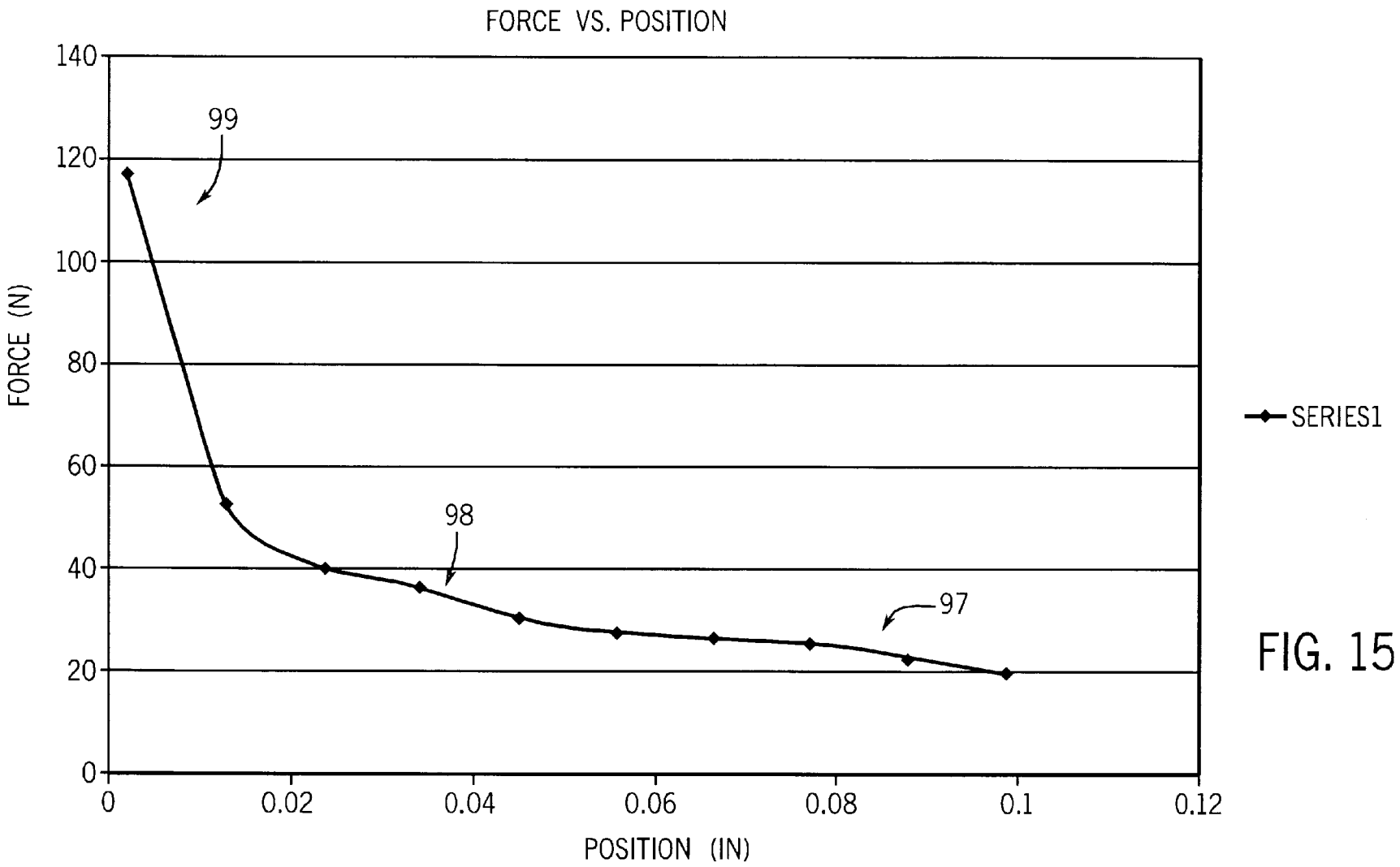
FIG. 15 is a graph of attractive force as a function of displacement of the armature for the latching solenoid of FIG. 10.

A graph of attractive force, in Newtons, as a function of displacement, in millimeters, of the armature for the latching solenoid 60 of FIGS. 9–12 is shown in FIG. 15.

Figure 17:
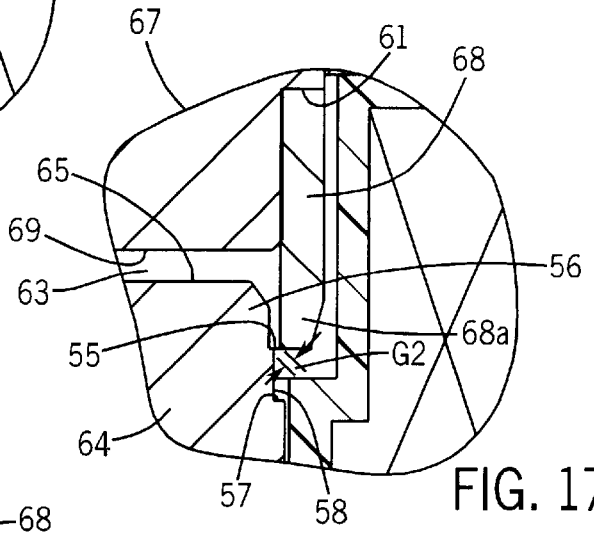
FIG. 17 is a view similar to that of FIG. 16 and with the armature moved toward the pole member.
Figure 18:
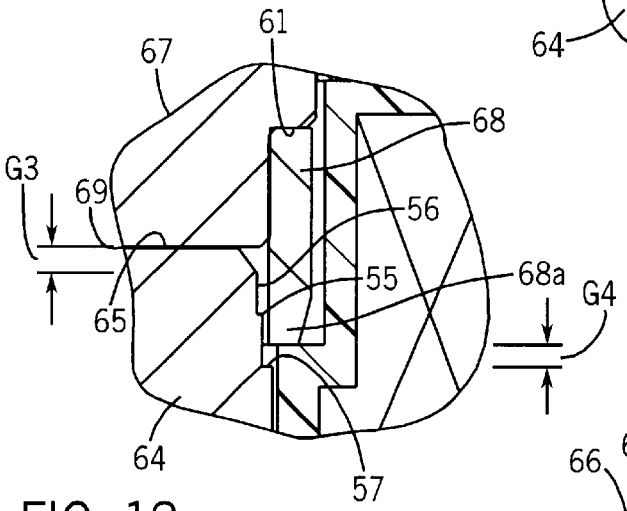
FIG. 18 is a detail view of a portion of the latching solenoid contained within the circle in FIG. 12.

Referring to FIGS. 16–18, together with FIG. 15, the stepped pole 64, in combination with the shoulder 61 on the armature 67 near the armature face 69, controls the magnetic timing. When the armature 67 is in the disengaged position, as shown in FIG. 16, the end 68*a* of the shunt member 68 is in the proximity of the smaller diameter portion 56 of the pole member 64 and the main working air gap is indicated generally by G1 and this position corresponds to that represented by reference numeral 97 in FIG. 15. The force required to cause the armature 67 to begin moving toward the position is less than 20 Newtons.

Referring to FIG. 17, as the armature 67 is driven towards the engaged position and the end 68*a* of the shunt member 68 approaches the step or shoulder 57 at the larger diameter portion 56 of the pole 64, the main working air gap is G2. This position corresponds to that represented by reference numeral 98 in FIG. 15. The force required to continue moving the armature 67 toward the position increases to less than 40 Newtons.

Referring to FIG. 18, as the armature nears the engaged position, the face 69 of the armature 67 begins to interact with the face 65 of the pole 64 and the main working air gap comprises air gap G3 and an air gap G4 resulting from interaction between the shunt member 68 and the step 57. This area is shown at in FIG. 15, as slightly higher forces and account for the slope of curve indicated by reference numeral 99.

The shunt rings and the radial air gaps G1, G2 and G4 even out the net force over the length of the stroke so that the magnetic force is substantially constant or linear, as shown in FIG. 18, once the static forces have been overcome. The linear increase of the magnetic force is designed to counter the linear increase of reactionary force produced by a linear bias member. Changing flux coupling is produced by the stepped pole member 64 and the stepped armature, including the shunt member 68 on the armature 67, as these features come into proximity with one another.

Referring to FIG. 15, there is shown a graph of attractive force, in Newtons, as a function of displacement, in millimeters, of the armature 67 for the latching solenoid 60 of FIGS. 9–11. In one embodiment in which latching solenoid 60 has a 0.10 inch stroke, the height of the shunt member 68 extending beyond the armature surface 69 was approximately 0.10 inch.

The right side of the curve represents the disengaged condition for the armature 67 and the left side of the curve represents the engaged condition. As shown by the curve, the magnetic flux shunt structure tends to equalize the attractive force over the length of the stroke. In one embodiment, the magnetic force varies within a range of about 20 Newtons to 40 Newtons over a stroke length from about 0.10 inch to about 0.02 inch. Also, the magnetic flux shunt structure results in a greater magnetic attractive force at relatively long strokes than is obtainable for latching solenoids that do not include a magnetic flux shunt structure.

Figure 19:
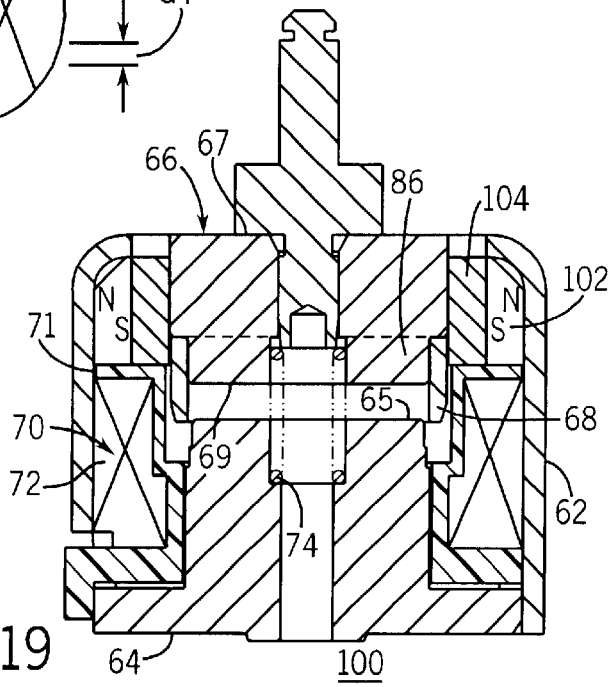
FIG. 19 is a vertical section view of a further embodiment of a latching solenoid provided by the invention and in which the magnetic force for providing the latching function is produced by a permanent magnet.

Referring to FIG. 19, in accordance with a further embodiment, a latching solenoid 100 includes a permanent magnet 102 for maintaining the armature 67 in a position to which it has been driven. The latching solenoid 100 is generally similar to solenoid 60 described above with reference to FIGS. 9–18 and elements of latching solenoid 100 have been given the same reference numerals as corresponding elements of latching solenoid 60 and these elements will not be described in detail.

The permanent magnet 102 is located in the magnetic flux path for the magnetic flux produced by the solenoid winding 72. In one embodiment, the permanent magnet 102 is a ring-shaped magnet and is oriented with its north pole disposed near the case 62 and its south pole disposed near the armature 67. A spacer washer 104 of a magnetic material, such as steel, is interposed between the outer surface of the permanent magnet 102 and the inner surface of the case 62. The upper edge of the case extends over the permanent magnet 102, but does not extend to the armature 67, such that magnetic leakage from the permanent magnet directly to the armature through the case is substantially prevented.

While in one preferred embodiment, the permanent magnet 102 is located within the magnetic circuit near the solenoid coil assembly, the permanent magnet 102 can be located at other positions within the magnetic circuit as commonly known in the art. For example, the permanent magnet 102 can be located near the inner end 86 of the armature 67 or can be mounted on the pole face 65.

To drive the armature 67 from the disengaged position to the engaged position, a drive pulse of a first polarity is applied to solenoid coil. The application of a drive pulse to the solenoid winding 72 causes a magnetic field to be produced which adds to the magnetic field produced by the permanent magnet 102. The resultant magnetic field causes the armature 67 to be moved toward the engaged position against the force of the bias member 74. The armature 67 is maintained in the engaged position by the magnetic field produced by the permanent magnet 102.

To release the armature 67 from the engaged position, a release pulse is applied to the solenoid winding 72 for producing a magnetic field in the direction opposite to that of the attracting field produced by the permanent magnet 102, and equal to or similar to the permanent magnet field. Consequently, the net magnetic attractive force is less than the force produced by the bias member 74, allowing the armature 67 to be returned to the disengaged position by force of the bias member 74.

Figure 20:
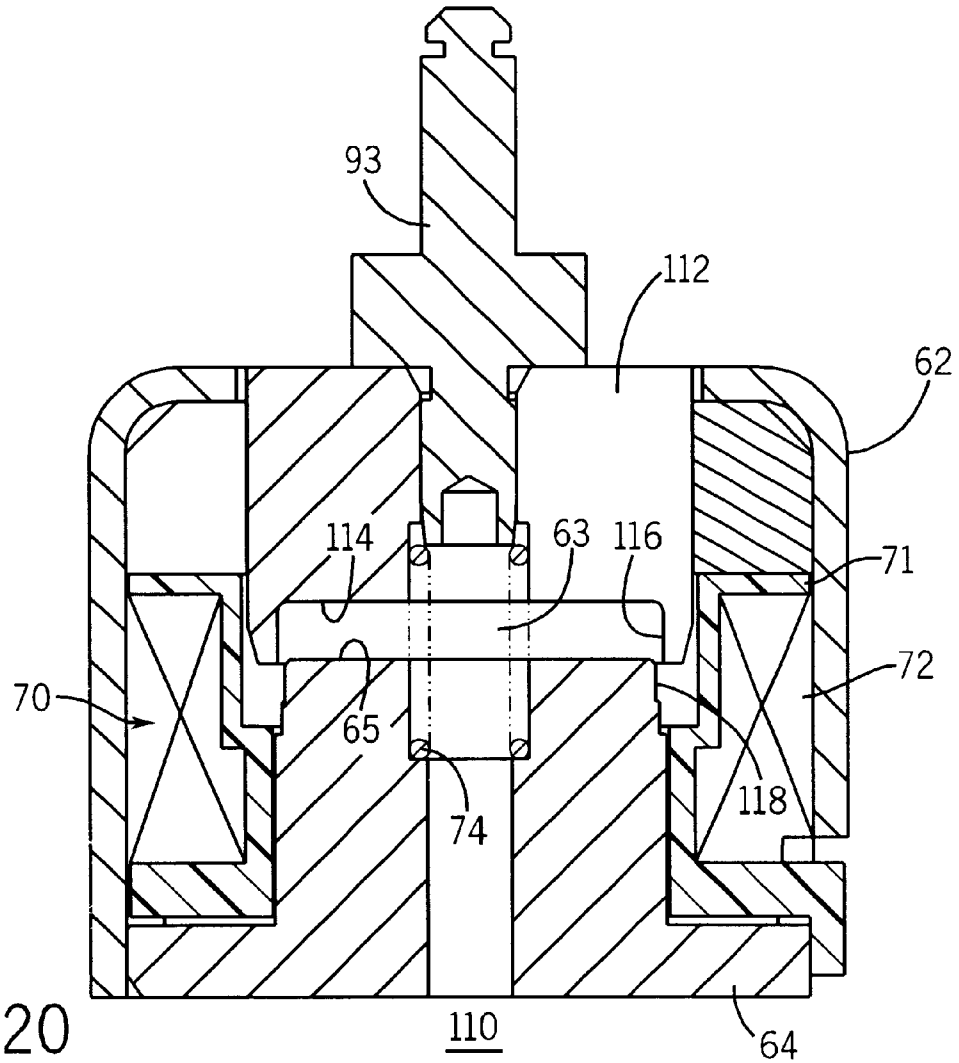
FIG. 20 is a vertical section view of a further embodiment of a latching solenoid provided by the present invention.
Figure 21:
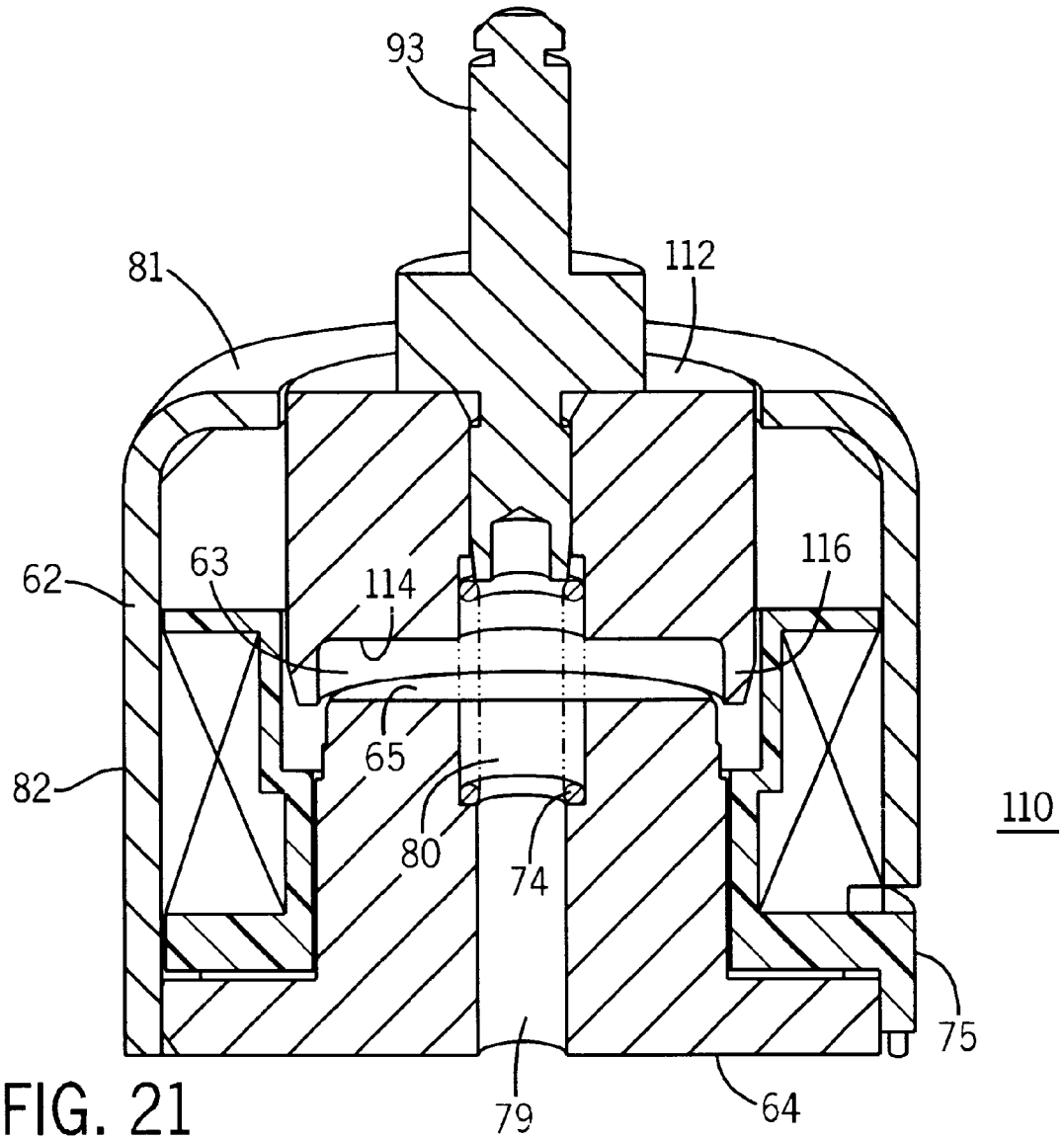
FIG. 21 is an isometric view, in section, of the latching solenoid of FIG. 20.
Figure 22:
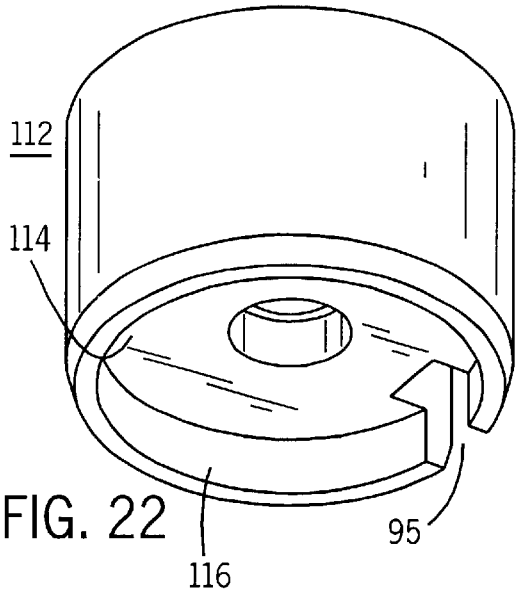
FIG. 22 is an isometric view of the armature of the latching solenoid of FIG. 21.
Figure 23:
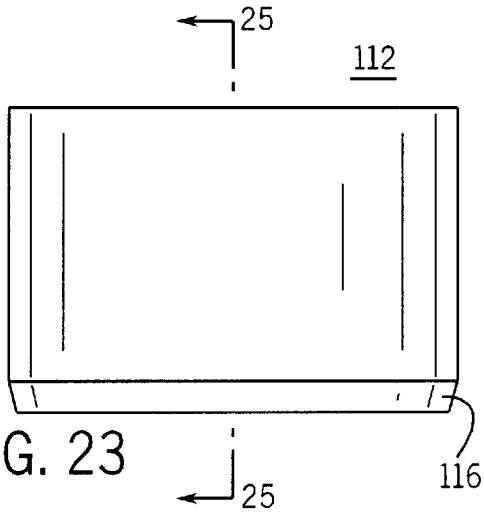
FIG. 23 is a side elevation view of the armature of FIG. 22.
Figure 24:
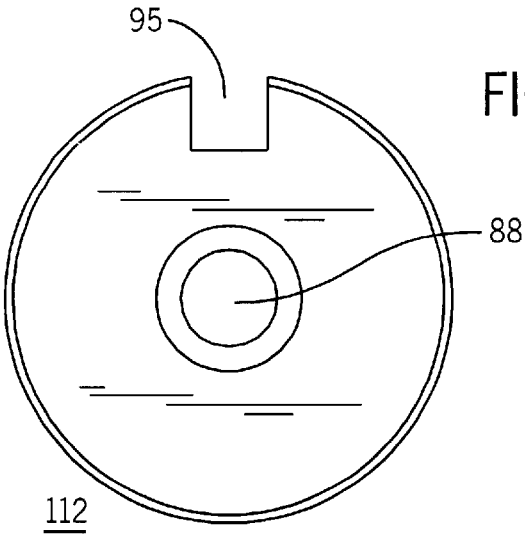
FIG. 24 is a top plan view of the armature of FIG. 22.
Figure 25:
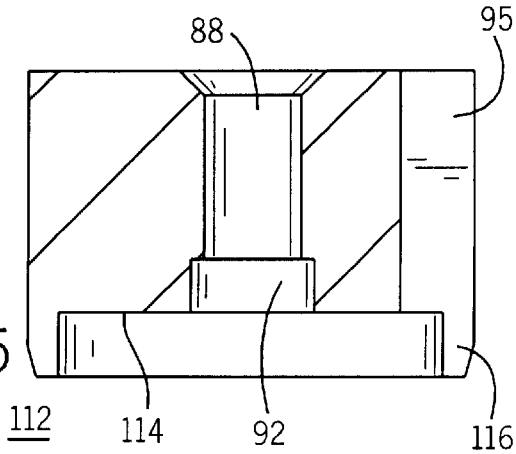
FIG. 25 is a vertical section view taken along the line 25—25 FIG. 23.

Referring to FIGS. 20 and 21, there is shown a further embodiment of a latching solenoid 110 provided in accordance with the invention. The latching solenoid 110 is similar to latching solenoid 60. However, for latching solenoid 110, the magnetic flux shunt member is formed integrally with the armature 112. The latching solenoid 110 is generally similar to solenoid 60 described above with reference to FIGS. 9–18, and elements of latching solenoid 110 have been given the same reference numerals as corresponding elements of latching solenoid 60 and these elements will not be described in detail.

Referring also to FIGS. 22–25, the armature 112 is a cylindrical element made of steel or some other magnetic material. The armature 112 has one end surface 114 disposed in an opposing spaced relationship with the end surface 65 of the magnetic pole member 64. The armature 112 has an annular peripheral shoulder projecting towards the magnetic pole member 64, defining a saturation tip 116. The saturation tip preferably is formed as an integral portion of the armature 114. The inner diameter of the saturation tip 116 is larger than the outer diameter of the magnetic pole member 64. This allows the armature 112 to be moved substantially axially relative to the magnetic pole member 64, with the saturation tip 116 being moved to overlie or overlap the peripheral edge 118 of the magnetic pole member 64.

The saturation tip 116 functions generally in the manner of shunt ring 24 (FIG. 1) to provide a low reluctance magnetic flux path between the pole member 64 and the armature 112 as the armature 112 is being driven toward the engaged position. However, saturation tip 116 is formed integrally with the armature 112, rather than being located adjacent to the pole member in the manner of shunt ring 24. As described above with reference to FIGS. 5 and 6, for the condition in which the armature 112 is positioned spaced apart from the pole member 64, such that an air gap 63 is provided between the armature face 114 and the pole face 65, the saturation tip 116 provides a shunt path around the air gap 63 for the magnetic flux, with the magnetic flux passing through the saturation tip 116 from the pole member 64 to the armature 112. Without the saturation tip, magnetic flux would have to pass through the relatively high reluctance air gap 63 that exists between the opposing surfaces of the armature 112 and the pole member 64 when the armature is moved toward the pole member 64.

In one preferred embodiment, the armature 112 is maintained in the engaged position by a magnetic force produced by the effects of residual magnetism. However, the armature 112 can be maintained in the engaged position by a magnetic field produced by a permanent magnet, in the manner of latching solenoid 100 as described above with reference to FIG. 19.

Although exemplary embodiments of the present invention have been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A latching solenoid comprising:

a pole member of a magnetic material, said pole member including a pole face;

an armature of a magnetic material, said armature including an armature end portion having an armature face opposing said pole face, said armature being supported for movement relative to said pole face between first and second positions, said armature face being spaced apart from said pole face defining an air gap between said armature face and said pole face when said armature is in said first position;

a coil assembly for producing magnetic flux along a magnetic flux path for moving said armature from said first position to said second position, said armature being maintained in said second position by the effects of a magnetic force; and a magnetic flux shunt member of a magnetically permeable material carried by said armature, said magnetic shunt member being located adjacent to said pole face, said magnetic shunt member being configured and arranged to shunt at least a portion of the air gap between said armature face and said pole face when said armature is in said first position to provide a low reluctance magnetic flux path between said pole member and said armature, wherein said magnetic shunt member is of a material that is different from the material of said armature, and wherein the coil assembly includes a step-wound coil, the step-wound coil including a first winding portion having a first inner diameter, and a second winding portion having a second inner diameter which is larger than the first inner diameter and which is larger than an outer diameter of said armature end portion, defining a region of increased diameter receiving at least a portion of said magnetic flux shunt member, allowing at least said portion of said magnetic flux shunt structure to overlap said end portion of said pole piece when said armature is at said second position member to overlap said end portion of said pole piece when said armature is at said second position.

2. The solenoid according to claim 1, wherein said armature face and said pole face have flat surfaces, and wherein the magnetic force for maintaining said armature in said second position is produced by the effects of residual magnetism.

3. The solenoid according to claim 1, and including a permanent magnet in a magnetic flux path for said electromagnetic actuating mechanism, and wherein magnetic force for maintaining said armature in said second position is produced by said permanent magnet.

4. A latching solenoid comprising:

a pole member of a magnetic material, said pole member including a pole face;

an armature of a magnetic material, said armature including an armature end portion having an armature face opposing said pole face, said armature being supported for movement relative to said pole face between first and second positions, said armature face being spaced apart from said pole face defining an air gap between said armature face and said pole face when said armature is in said first position;

a coil assembly for producing magnetic flux along a magnetic flux path for moving said armature from said first position to said second position, said armature being maintained in said second position by the effects of a magnetic force; and a magnetic shunt member which is fixed to said armature end portion, said magnetic shunt member being located adjacent to said pole face, said magnetic shunt member being configured and arranged to shunt at least a portion of the air gap between said armature face and said pole face when said armature is in said first position to provide a low reluctance magnetic flux path between said pole member and said armature, wherein said magnetic shunt member is of a material that is different from the material of said armature, and wherein the coil assembly includes a step-wound coil, the step-wound coil including a first winding portion having a first inner diameter, and a second winding portion having a second inner diameter which is larger than the first inner diameter and which is larger than an outer diameter of said armature end portion, defining a region of increased diameter containing said magnetic shunt member, allowing at least a portion of said magnetic shunt member to overlap said end portion of said pole piece when said armature is moved toward said second position.

5. The solenoid according to claim 4, wherein said armature includes a shoulder near said end portion, and wherein said magnetic shunt member is mounted on said shoulder of said armature.

6. A latching solenoid comprising:

a pole member of a magnetic material, said pole member including a pole face;

an armature of a magnetic material, said armature including an armature end portion having an armature face opposing said pole face, said armature being supported for movement relative to said pole face between first and second positions, said armature face being spaced apart from said pole face defining an air gap between said armature face and said pole face when said armature is in said first position;

a coil assembly for producing magnetic flux along a magnetic flux path for moving said armature from said first position to said second position, said armature being maintained in said second position by the effects of a magnetic force; and a magnetic flux shunt structure of a magnetically permeable material carried by said armature, said magnetic shunt flux shunt structure being located adjacent to said pole face, said magnetic flux shunt structure and being configured and arranged to shunt at least a portion of the air gap between said armature face and said pole face when said armature is in said first position to provide a low reluctance magnetic flux path between said pole member and said armature, wherein said magnetic flux shunt structure comprises a magnetic shunt member which is fixed to said armature end portion, wherein said armature includes a shoulder near said end portion, said magnetic shunt member mounted on said shoulder of said armature, and wherein said magnetic shunt member is of a material that is different from the material of said armature.

7. A latching solenoid comprising:

a pole member of a magnetic material, said pole member including a pole face;

an armature of a magnetic material, said armature including an armature end portion having an armature face opposing said pole face, said armature being supported for movement relative to said pole face between first and second positions, said armature face being spaced apart from said pole face defining an air gap between said armature face and said pole face when said armature is in said first position;

a coil assembly for producing magnetic flux along a magnetic flux path for moving said armature from said first position to said second position, said armature being maintained in said second position by the effects of a magnetic force; and a magnetic flux shunt structure of a magnetically permeable material carried by said armature, said magnetic shunt flux shunt structure being located adjacent to said pole face, said magnetic flux shunt structure and being configured and arranged to shunt at least a portion of the air gap between said armature face and said pole face when said armature is in said first position to provide a low reluctance magnetic flux path between said pole member and said armature, wherein said magnetic flux shunt structure comprises a magnetic shunt member which is fixed to said armature end portion, wherein said armature includes a shoulder near said end portion, said magnetic shunt member mounted on said shoulder of said armature, and wherein the material of said armature is harder than the material of said magnetic shunt member.

8. The solenoid according to claim 4, wherein the shunt member has a minimum inner diameter that is greater than the outer diameter of the armature and the outer diameter of the pole face, and the outer diameter of the armature face corresponds to the outer diameter of the pole face, thereby maximizing the working diameter of the pole face and the working diameter of the armature face that is coextensive with the pole face, and wherein at least a portion of said magnetic shunt member overlaps a portion of said pole member axially when said armature is in said second position.

9. The solenoid according to claim 4, and including a bias structure producing a bias force for moving said armature to said first position.

10. The solenoid according to claim 4, and including means for indexing said armature relative to said case.

11. A latching solenoid comprising:

a pole member of a magnetic material, said pole member including a pole end portion having a pole face;

an armature of a magnetic material, said armature being supported for movement relative to said pole member between first and second positions, said armature including an armature end portion having an armature face opposing said pole face, said armature face being spaced apart from said pole face defining an air gap between said armature face and said pole face when said armature is in said first position and said armature face engaging said pole face when said armature is in said second position;

a magnetic flux shunt structure carried by said armature and located adjacent to said pole end portion, said magnetic flux shunt structure being of a magnetically permeable material that is different from the material of said armature, and said magnetic flux shunt structure being configured and arranged to shunt at least a portion of the air gap between said armature face and said pole face when said armature is in said first position for providing a low reluctance magnetic flux path between said pole member and said armature when said armature is in said first position, said magnetic flux shunt structure having a minimum inner diameter that is greater than the outer diameter of the armature and the outer diameter of the pole face, and the outer diameter of the armature face corresponding to the outer diameter of the pole face, thereby maximizing the working diameter of the pole face and the working diameter of the armature face that is coextensive with the pole face; and, a coil assembly for producing magnetic flux along a magnetic flux path for moving said armature relative to said pole member to said second position, said armature being maintained in said second position by the effects of residual magnetism, wherein the coil assembly includes a step-wound coil, the step-wound coil including a first winding portion having a first inner diameter, and a second winding portion having a second inner diameter which is larger than the first inner diameter and which is larger than an outer diameter of said armature end portion, defining a region of increased diameter receiving at least a portion of said magnetic flux shunt structure, allowing at least a portion of said magnetic flux shunt structure to overlap said end portion of said pole piece when said armature is moved toward said second position.

12. The solenoid according to claim 11, wherein said contains at least said portion of said magnetic flux shunt structure when said armature is in said first position.

13. A solenoid comprising:

a magnetic pole piece having a pole end portion;

a magnetic flux shunt member;

an armature adapted for movement relative to said magnetic pole piece between first and second positions, said armature having an armature end portion which is located adjacent to said pole end portion, said armature end portion being spaced apart from said pole end portion when said armature is in the first position;

said magnetic flux shunt member being of a material that is different from the material of said armature, said magnetic flux shunt member being fixed to said armature end portion and projecting outwardly from said armature end portion, said magnetic flux shunt member having an inner diameter that is greater than the outer diameter of said end portion of said pole piece, said magnetic flux shunt member having a minimum inner diameter that is greater than the outer diameter of the armature and the outer diameter of the pole face, and the outer diameter of the armature face corresponding to the outer diameter of the pole face, thereby maximizing the working diameter of the pole face and the working diameter of the armature face that is coextensive with the pole face; and a coil assembly including a step-wound coil for moving said armature relative to said magnetic pole piece, said step-wound coil including a first coil portion having a first inner diameter, and a second coil portion having a second inner diameter which is larger than the first inner diameter and which is larger than an outer diameter of said armature end portion, including said magnetic flux shunt member, defining a region of increased diameter receiving at least a portion of said magnetic flux shunt member, allowing at least said portion of said magnetic flux shunt member to overlap said end portion of said pole piece when said armature is at said second position.

* * * * *